US007252741B2

(12) United States Patent
Yeh et al.

(10) Patent No.: US 7,252,741 B2
(45) Date of Patent: Aug. 7, 2007

(54) METHOD OF MAKING A PAPER WEB CONTAINING REFINED LONG FIBER USING A CHARGE CONTROLLED HEADBOX AND A SINGLE PLY TOWEL MADE BY THE PROCESS

(75) Inventors: Kang Chang Yeh, Neenah, WI (US); Gary L. Worry, Appleton, WI (US); Thomas N. Kershaw, Neenah, WI (US); Henry S. Ostrowski, Appleton, WI (US)

(73) Assignee: Georgia-Pacific Consumer Products LP, Atlanta, GA (US)

( * ) Notice: Subject to any disclaimer, the term of this patent is extended or adjusted under 35 U.S.C. 154(b) by 70 days.

(21) Appl. No.: 11/260,660

(22) Filed: Oct. 27, 2005

(65) Prior Publication Data

US 2006/0032595 A1 Feb. 16, 2006

Related U.S. Application Data

(60) Continuation of application No. 10/022,538, filed on Dec. 20, 2001, now Pat. No. 6,998,016, which is a division of application No. 08/730,292, filed on Oct. 11, 1996, now Pat. No. 6,419,789.

(51) Int. Cl.
*D21H 23/10* (2006.01)
*D21H 21/20* (2006.01)
*D21F 11/00* (2006.01)

(52) U.S. Cl. ..... 162/198; 162/109; 162/111; 162/113; 162/117; 162/164.1; 162/183; 162/DIG. 11

(58) Field of Classification Search ..... 162/109–117, 162/149, 158, 164.1, 164.3, 164.6, 168.1, 162/168.2, 168.3, 166, 175, 177, 183, 198, 162/DIG. 11; 428/152–154, 340–342
See application file for complete search history.

(56) References Cited

U.S. PATENT DOCUMENTS

| | | | |
|---|---|---|---|
| 2,610,935 | A | 9/1952 | Rowo |
| 3,017,317 | A | 1/1962 | Voigtman et al. |
| 3,058,873 | A | 10/1962 | Keim et al. |
| 3,432,936 | A | 3/1969 | Cole et al. |

(Continued)

FOREIGN PATENT DOCUMENTS

| | | |
|---|---|---|
| CA | 2076615 | 4/1993 |

(Continued)

OTHER PUBLICATIONS

Epsy, H.H. "Poly(Aminoamide)—Epichlorohydrin Resin—Carboxy methylcellulose Combinations for Wet and Dry Strength In Paper," *Papermakers Conference Proceedings,* 1983.

(Continued)

*Primary Examiner*—Eric Hug
(74) *Attorney, Agent, or Firm*—Finnegan, Henderson, Farabow, Garrett & Dunner, L.L.P.

(57) ABSTRACT

A method of forming a cellulosic web is discussed, the product of which may, for example, possess at least one of increased softness, strength, and absorbency. The method measures the total anionic charge and controls the net charge of an aqueous stream.

6 Claims, 11 Drawing Sheets

The Relationship Between Wet Geometric Mean Breaking Length (WGMBL) and Headbox Titratable Charge

U.S. PATENT DOCUMENTS

| | | | | | |
|---|---|---|---|---|---|
| 3,556,932 | A | | 1/1971 | Coscla et al. | |
| 3,556,933 | A | | 1/1971 | Williams et al. | |
| 3,620,911 | A | | 11/1971 | Eklund | |
| 3,700,623 | A | | 10/1972 | Keim | |
| 3,772,076 | A | | 11/1973 | Kelm | |
| RE28,459 | E | | 7/1975 | Cole et al. | |
| 3,998,690 | A | * | 12/1976 | Lyness et al. | 162/141 |
| 4,191,609 | A | | 3/1980 | Trokhan | |
| 4,239,065 | A | | 12/1980 | Trokhan | |
| 4,528,316 | A | | 7/1985 | Soerens | |
| 4,501,640 | A | | 12/1985 | Soerens | |
| 4,684,439 | A | | 8/1987 | Soerens | |
| 4,752,356 | A | | 6/1988 | Taggert et al. | |
| 4,788,243 | A | | 11/1988 | Soerens | |
| 5,025,046 | A | | 6/1991 | Soerens | |
| 5,048,589 | A | | 9/1991 | Cook et al. | |
| 5,277,761 | A | | 1/1994 | Van Phan et al. | |
| 5,281,307 | A | | 1/1994 | Smigo et al. | |
| 5,316,623 | A | | 5/1994 | Espy | |
| 5,318,669 | A | | 6/1994 | Dasgupta | |
| 5,320,710 | A | | 6/1994 | Reeves et al. | |
| 5,326,434 | A | | 7/1994 | Carevic et al. | |
| 5,338,407 | A | | 8/1994 | Dasgupta | |
| 5,368,694 | A | * | 11/1994 | Rohlf et al. | 162/199 |
| 5,397,435 | A | | 3/1995 | Ostendorf et al. | |
| 5,437,766 | A | | 8/1995 | Van Phan et al. | |
| 5,502,091 | A | | 3/1996 | Dasgupta | |
| 5,633,300 | A | | 5/1997 | Dasgupta | |
| 6,022,449 | A | * | 2/2000 | Jansen et al. | 162/135 |
| 6,419,789 | B1 | | 7/2002 | Yeh et al. | |

FOREIGN PATENT DOCUMENTS

| | | | |
|---|---|---|---|
| EP | 0 548 960 | A1 | 6/1993 |

OTHER PUBLICATIONS

Wolf, M., "Practical Experiment with Determination of Ionic Charges In Paper-Machine Circuits," *Wochenblatt fuer Papierfabrikation,* vol. 118, No. 11/12, Jun. 1990, pp. 520-523.

Brouwer, P.H. "The relationship between zeta potential and Ionic demand and how it affects wet-end retention," *Tappi Journal,* Jan. 1991, p. 170.

McKague, J.F., "Practical applications of the electrokinetics of papermaking," *Tappl Journal,* Dec. 1974, vol. 57, No. 12, p. 101.

Patton, P.A., et al. "Charge Analyses: Powerful Tools in Wet End Optimization", Papermakers Conference Proceedings, 1993, p. 555.

Griggs, W.H., et al., "Wet end sizing—an overview," *Tappi Journal,* Jun. 1980, vol. 63, No. 6, p. 49.

Moore, E.E., "Drainage and retention mechanisms of papermaking systems treated with cationic polymers," *Tappi Journal,* Jan. 1975, vol. 58, No. 1, p. 99.

Sandstrom, E.R., "Paper Chemistry: First pass fines retention critical to efficiency of wet strength resin", *Paper Trade Journal,* Jan. 30, 1979, p. 47.

Dixit, M.K., et al., "Retention strategies for alkaline fine papermaking with secondary fiber: a case history", *Tappi Journal,* Apr. 1991, p. 107.

King, C.A., "Charge and Papermachine Operation," *Papermakers Conference Proceedings,* 1992, p. 5.

Strazdins, E., "Factors Affecting Retention of Wet-End Additives," *Tappi Journal,* vol. 53, No. 1, Jan. 1970, p. 80.

Strazdins, E., "Optimization of the papermaking process by electrophoresis," *Tappi Journal,* Jul. 1977, vol. 60, No. 7, p. 113.

Strazdins, E., "Microelectrophoresis Theory and Praxls," *Papermakers Conference Proceedings,* 1992, p. 503.

Strazdins, E., "Application of Electrokinetics in Optimization of Wet-End Chemistry," *Wet Strength Resins and Their Applications,* 1994, Ch. 4, p. 63.

Strazdins, E., "Chemical aids can offset strength loss In secondary fiber furnish use." *Pulp & Paper.* Mar. 1984, p. 73.

Westfelt, L., "Chemistry of paper Wet Strength. I. A survey of Mechanisms of Wet-Strength Development," *Cellulose Chem. Techn.,* vol. 13, 1979, p. 813.

Espy, H.H., "Alkaline-Curing Polymeric Amine-Epichlorohydrin Resins," *Wet-Strength Resins and Their Application*, 1994, Ch. 2, p. 13.

Hiemenz, P., "Application of Electrokinetics in Optimization of Wet End Chemistry in Wet Strength Resin and Their Application," *Principles of Colloid and Surface Chemistry,* Ch. 4, 1994.

St. John, Ph.D., Michael R., "Evaluation of the Charge State of Papermachine Systems Using the Charge Titration Method," 1992 Paper Conference, pp. 479-502.

Neal, Charles W., "A Review of the Chemistry of Wet Strength Development", Proctor & Gamble, 1988 Wet and Dry Strength, pp. 1-24. (1988).

Wolf, M., "Practical Experience with Determination of Ionic Charges in Paper-Machine Circuits", Wochenblatt fuer papierfabrikation, vol. 118, No. 11/12, pp. 520-523, Jun. 1990. Library Information Services Division (translated Mar. 1, 1996).

Co-Pending U.S. Appl. No. 10/022,538.

* cited by examiner

THE RELATIONSHIP BETWEEN MONADIC FEEL OF TOWEL WHEN DRYING HANDS AND GEOMETRIC MEAN WET TENSILE STRENGTH

THE RELATIONSHIP BETWEEN MONADIC SPEED OF ABSORBENCY WHEN DRYING HANDS AND GEOMETRIC MEAN WET TENSILE STRENGTH / BASIS WEIGHT

THE RELATIONSHIP BETWEEN MONADIC SPEED OF ABSORBENCY WHEN DRYING HANDS AND GEOMETRIC MEAN WET TENSILE STRENGTH

THE RELATIONSHIP BETWEEN SENSORY SOFTNESS AND GEOMETRIC MEAN WET TENSILE STRENGTH

* Commercial towel products have sensory softness of <<0

THE RELATIONSHIP BETWEEN MONADIC OVERALL RATING AND GEOMETRIC MEAN WET TENSILE STRENGTH

THE RELATIONSHIP BETWEEN TENSILE MODULUS AND GEOMETRIC MEAN WET TENSILE STRENGTH

THE RELATIONSHIP BETWEEN ABSORBENCY AND GEOMETRIC MEAN WET TENSILE STRENGTH

THE RELATIONSHIP BETWEEN ABSORBENCY AND GEOMETRIC MEAN WET TENSILE STRENGTH / BASIS WEIGHT

THE RELATIONSHIP BETWEEN MONADIC THOROUGHNESS OF HAND DRYING AND GEOMETRIC MEAN WET TENSILE STRENGTH

Figure 10 : The Relationship Between Wet Geometric Mean Breaking Length (WGMBL) and Headbox Titratable Charge
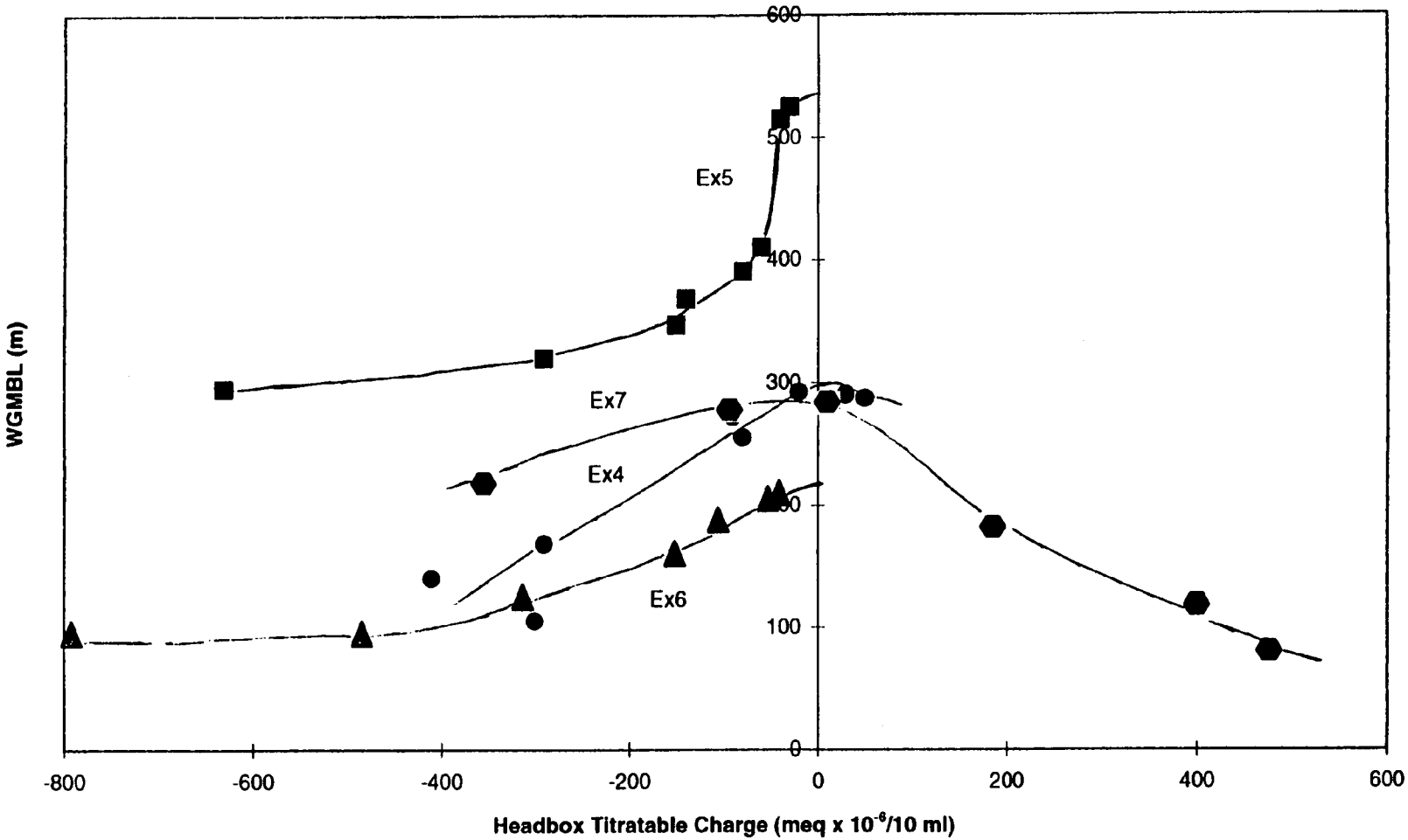

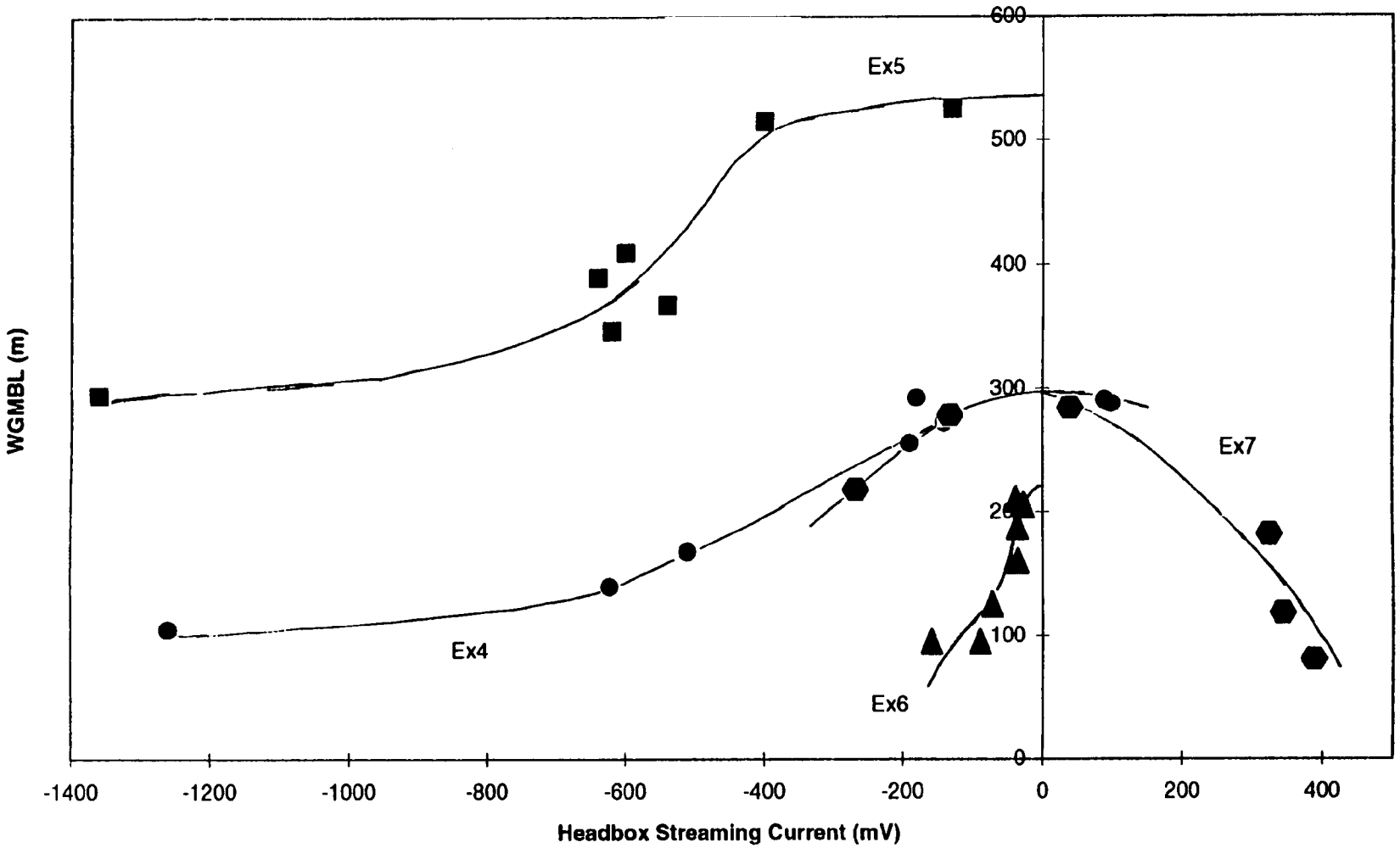
Figure 11 : The Relationship Between Wet Geometric Mean Breaking Length (WGMBL) and Headbox Streaming Current

METHOD OF MAKING A PAPER WEB CONTAINING REFINED LONG FIBER USING A CHARGE CONTROLLED HEADBOX AND A SINGLE PLY TOWEL MADE BY THE PROCESS

This is a continuation of application Ser. No. 10/022,538 filed Dec. 20, 2001 (now U.S. Pat. No. 6,998,016 issued Feb. 14, 2006), which is a divisional of application Ser. No. 08/730,292 filed Oct. 11, 1996 (now U.S. Pat. No. 6,419,789 issued Jul. 16, 2002), each of which is incorporated herein by reference in its entirety.

FIELD OF THE INVENTION

The present invention relates to a method of making a paper web having superior strength, absorbency and softness. The invention further relates to a non-compacted paper web produced with a headbox furnish composition maintained at an average anionic charge level in a specific range. More particularly, the invention relates to a non-compacted paper web made from a refined long fiber furnish containing high levels of wet strength additives at an average anionic charge level in the headbox in a specific range. Still more particularly, the present invention relates to a single ply towel product having improved strength, softness and absorbency.

BACKGROUND OF THE INVENTION

Folded and roll paper toweling, such as that used in commercial, "away-from-home" dispensers, is a relatively modest product normally sold almost exclusively on the basis of cost since the purchaser is rarely the user. Because improved performance rarely justifies even a minimal increase in cost, techniques for improving the quality of this product have previously centered around those satisfying the most stringent of economic criteria. Recent market trends have seen a shift toward improved product characteristics; however, economics are still closely monitored.

Traditionally, the production of away-from-home toweling occurs by one of three basic technologies: (i) conventional wet press technology with wet creping and embossing; (ii) conventional wet press technology with dry creping and embossing; and most recently (iii) through-air-drying without creping. Each of these technologies has its own advantages and disadvantages.

Conventional wet press technology with wet creping and embossing results in a product having good strength when saturated with aqueous liquids. This technology suffers from the disadvantage that the product lacks sufficient absorbent capacity and softness. As described in U.S. Pat. No. 5,048,589 to Cook et al., herein incorporated by reference in its entirety, towels made from a conventionally wet pressed, wet crepe process "are normally strong even when saturated with liquid, but often lack desirable levels of absorbent capacity, absorbent rate, and softness."

Conventional wet press technology with dry creping and embossing results in a product having good absorbent capacity and softness; but the product lacks strength when saturated with aqueous liquids. U.S. Pat. No. 5,048,589 to Cook et al. describes products made by this method as " . . . soft towels possess high levels of absorbent capacity and absorbent rate, however, these soft towels are also very weak and tend to break apart when saturated with liquid."

Through-air-drying without creping is also disclosed, for example, in U.S. Pat. No. 5,048,589. The '589 patent discloses towels with good absorbent capacity and strength when saturated with an aqueous liquid. Uncrepe technology as described in the '589 patent was developed to overcome some of the difficulties in making soft, strong, and absorbent wiper towels.

Although through-air-drying with both creping and embossing can result in a product that is relatively soft and absorbent, this product is generally regarded as a retail in-home towel because of its marginal strength. For example, a particularly successful through air dried towel marketed as a retail in-home product is two-ply Bounty®. Two successful high quality away-from-home folded towels are single-ply KC Surpass® 50000 and Scott Select® 189. The geometric mean wet tensile strength of Bounty® is approximately 895 g/3", while the geometric mean wet tensile strengths of KC Surpass® 50000 and Scott Select® 189 are generally 1297 g/3" and 970 g/3", respectively. Clearly, conventional retail in-home through-air dried towel products are lower in strength. So, for applications where strength is an important consideration, e.g., in the area of away-from-home toweling, traditionally through-air-drying is not coupled with operations that lead to a decrease in strength, for example, dry creping or embossing.

The present invention provides a method of overcoming the disadvantages associated with each of the prior art technologies. The method according to the present invention produces a single-ply towel using through-air-drying, creping, and embossing that does not suffer from the marginal strength of prior art towel products while maintaining both high softness and good absorbency. This is accomplished through the use of an anionic/cationic thermally cross-linking strength additive system at a headbox charge controlled to a specific anionic range; preferably in conjunction with a furnish having as its major component, refined long fibers; and high levels of wet strength/dry strength resins.

Prior art through-air-drying processes do not provide a method for making a strong, soft, and absorbent away-from-home hand drying towel using high levels of refined softwood, adding high levels of wet strength resin, and adding wet/dry strength resins to appropriately control headbox charge to a specified anionic range.

U.S. Pat. No. 3,998,690 to Lyness et al., incorporated herein by reference in its entirety, discloses a chemical flocculation technique for using short fiber to make bulky webs. Flocculation of the furnish tends to produce aggregates that apparently cause a short fiber furnish to act like a long fiber furnish. Lyness et al. discloses the use of wet strength resins or other cationic agents and anionic agents for inclusion in a bifurcated furnish which requires the use of a complex stock system. Although Lyness et al. discloses that a stoichiometric charge density balance of the anionic/cationic pairs can be used, they do not include the furnish as part of the charge balance. Furthermore, measuring and controlling headbox charge to a specific anionic range for improved wet strength is not considered by Lyness et al.

There are numerous schemes for measuring the charge state of a wet end system. Two of the most common methods are described below: zeta potential via micro-electrophoresis and titratable charge.

When a negatively charged particle, such as a wood pulp fiber, is suspended in an aqueous solution, the negative surface attracts a considerable number of positive counterions next to the electrified interface. The counterions next to the electrified interface are strongly attracted into a thin layer referred to in the literature as the Stem layer. When a particle moves in solution, liquid immediately adjacent to the particle surface moves with the same velocity. This unknown boundary layer is referred to as the shear surface and contains the Stem layer. Therefore, in a fiber furnish, solution and counterions are bound to the moving electrified fiber particle in the shear/Stern layer.

Counterions tend to diffuse away from an electrified surface because of thermal motion, but they are also attracted by coulombic forces. These opposing effects cause charge concentration variations which effect the double layer potential in solution. Zeta potential is the double layer electrical potential at the shear surface. Salts added to a solution suppress the electrical potential or double layer potential in solution, and thus, reduce the zeta potential without changing the charge on the particle.

The most common technique for measuring zeta potential is by microelectrophoresis. Microelectrophoresis techniques require a particle dispersion to be placed in a cell and an electric field applied. The velocity of the particles is determined, e.g., microscopically. The mobility is calculated as the particle velocity per unit electric field. The zeta potential is then calculated from the Helmholtz-Smoluchowski equation as the mobility times the viscosity of medium divided by the dielectric constant of medium.

The electrostatic charge associated with papermaking particles and polyelectrolyte additives defines the cationic or anionic demand of a papermaking system. The most popular technique for measuring the state of charge of a wet end system is to titrate a papermaking sample, like a headbox sample, with known concentrations of standard cationic or anionic solutions. Frequently, the end point of the titration is zero streaming current or zero electrophoretic mobility. (The streaming current detector is an instrument used for characterizing colloidal surface charge by measuring the current generated by mobile counterions when charged material adheres to piston and cup walls while the piston moves.) The amount of standard charged material needed to neutralize the papermaking or headbox sample gives the charge state of the system.

Details on both the electrophoretic mobility and titratable charge techniques can be found in Principles of Colloid and Surface Chemistry by P. Hiemenz and in Chapter 4: *Application of Electrokinetics in Optimization of Wet End Chemistry* in Wet Strength Resin and Their Application (L. Chan, Editor, 1994).

The combined use of cationic and anionic strength adjusting agents to enhance the strength properties of paper webs has been the subject of much discussion. Charles W. Neal, *A Review of the Chemistry of Wet Strength Development* in 1988 *Tappi Seminar Notes* describes several commonly utilized wet strength additives, their preparation and chemical structure, their cross-linking reactions, and their effect on wet strength properties. This review includes a discussion of cationic/anionic additive systems such as the PAE/CMC (polyamidepolyamineepichlorohydrin/carboxy methyl cellulose) system. Neal describes the cationic additive as acting as a retention aid for the anionic additive. Neal discloses wet end chemistry parameters for optimum wet strength properties for the PAE resin system as including operation of the wet end at a pH level that is neutral to slightly alkaline with minimization of free chlorine via the use of an antichlorine agent.

Early development of a PAE/CMC system is described, for example, in U.S. Pat. No. 3,058,873 to Keim et al., assigned to Hercules. Keim et al. discloses a process for the production of improved wet strength paper using PAE type cationic resins and water soluble gums selected from the group consisting of water-soluble cellulose ethers (e.g. CMC) and cationic starches. Keim et al. state the improved wet strength from the PAE/CMC system is due to a synergistic effect involved when PAE and CMC are used in combination. Subsequent work by Hercules is described in, for example, Herbert H. Espy, *Poly(Aminoamide)—Epichlorohydyrin Resin—Carboxy Methyl Cellulose Combinations for Wet and Dry Strength in Paper*, 1983 Papermakers Conference Proceedings. Espy discusses the mechanism by which CMC contributes to retention of PAE beyond the simple demand by the pulp, thus improving not only wet strength but also dry strength of the paper web. For example, when CMC is added to a system containing high levels of PAE, a less cationic coacervate is formed, enabling more PAE to be deposited on the fiber. If excessive levels of CMC are added, anionic coacervates are formed which are not adsorbed onto the pulp fibers. This added retention is referred to by Espy as the synergy of these two strength additives. Espy describes electrophoretic mobility as a basis for determining optimum CMC/PAE ratios. Espy does not address the effect of the charge on the headbox furnish as a means for controlling and optimizing strength additives to a paper web and the resultant web properties.

Three methods for investigating charge in fiber suspensions are described in *Practical Experiment with Determination of Ionic Charges in Paper-Machine Circuits* by M. Wolf. The article which is incorporated herein by reference was published in Wochenblatt fuer Papierfabrikation, Vol 118, No. 11/12, pp. 520-523, June, 1990. The methods reviewed were polyelectrolyte titration (PE) with o-toluidine blue (TBO) as an indicator, polyelectrolyte titration using the streaming current detector (SCD) signal as the endpoint and electrophoresis. PE with TBO as an indicator measures the anionic and cationic demand of pulp slurries and filtrates via a back titration scheme which is plagued with procedural problems of altering the sample with distilled water and precisely determining the end point value visually. This technique was used in a paper board mill operating with native starch. Table 2 in this article shows that the headbox charge was in an over cationization state—outside the range of interest for operating a wet strength system on a towel and tissue paper machine. Also, Table 3 in this article shows that the addition of cationic starch increases the cationic nature of the mixing chest stock. For this example, no mention of controlling and measuring headbox charge in the range of less than about 0 to −115 meq$\times 10^{-6}$/10 ml is made when cationic starch is added. Also, cationic materials like wet strength resins and anionic materials like dry strength agents were not added, and the rate was not set so that headbox charge was adequately constrained.

The second technique for measuring stock charge conditions described in Wolf's article uses polyelectrolyte titration with the SCD to determine end point. This technique is a substantial improvement over the PE/TBO method. The specific anionic consumption (SAC) and specific cationic consumption (SCC) are outputs of the test. Since samples are not diluted with water, the ionogenity of the solution is maintained.

Examples in Table 4 of Wolf's article show the analysis of anionic trash in a groundwood containing coated paper machine using PE/SCD. Cationic fixing agents were used to eliminate anionic trash. The headbox charge was measured and reported to be extremely negative. The values are clearly outside the range of interest for operating a wet strength system on a towel and tissue paper machine.

Table 5 shows. PE/SCD results when cationic starches are used. Addition of cationic starch, especially starch B, increases bond strength. Headbox charge was not measured.

In one example in Table 5 and in another example in Table 6 of Wolf's article cationic starch is added in combination with anionic starch. White water PE/SCD values were measured. For the data in Table 5 the white water PE/SCD value increased (i.e. moved from a negative value to a less negative value) with a slight increase in bond strength. The data in Table 6 shows a decrease in white water PE/SAC values (i.e. moves from a positive value to a less positive value) with a corresponding increase in bond strength. Headbox charge was not measured. This article does not disclose the use of cationic wet strength agents/anionic dry strength agents as a means to maximize wet strength properties for a non-compacted hand drying towel. Furthermore, data from Table 5 does not disclose controlling and measuring headbox charge in the range of less than about 0 to −115 meq×$10^{-6}$/10 ml by controlling anionic/cationic starch levels.

Table 7 in Wolf's article shows data comparing the PE/SCD measurement with the electrophoretic mobility values. Measurements were made at headbox, cleaner stage, and machine chest. Zeta potential and PE/SCD values show that the system is slightly negative. Although PE/SCD charge values in the headbox are in the range of less than about 0 to −115 meq×$10^{-6}$/10 ml, the charge was not manipulated by using anionic/cationic additives.

In conclusion, Wolf measures PE/SCD at various points in a paper machine system but fails to show that maximum wet strength occurs when headbox charge is controlled in the range of less than about 0 to −115 meq×$10^{-6}$/10 ml by appropriately adjusting the cationic wet strength resin content and anionic dry strength resin content.

The P. H. Brouwer article entitled *The Relationship Between Zeta Potential and Ionic Demand and How It Affects Wet-End Retention* (Tappi Journal/January, 1991, p. 170) describes schemes for optimizing wet end starch retention by optimizing first pass retention via the use of retention aids and by keeping zeta potential and cationic/anionic demand close to zero. In one example of a paper machine making coating base paper from mechanical pulp and $CaCO_3$ filler with 0.5% polyaluminum chloride (PAC) added at the mixing chest, 0.8% cationic potato starch added just before the fan pump, and 0.02% retention aid before the headbox, COD levels exceeded acceptable limits. When PAC was increased to 1% and COD decreased from 200 mg/l to 155 mg/l, headbox cationic demand was reduced to 100 meq×$10^{-6}$/10 ml (i.e. headbox charge was −100 meq×$10^{-6}$/10 ml). In a second example, 80 g/$m^2$ packaging paper was made from a furnish consisting of 36% bleached long fiber, 38% bleached short fiber, 20% broke, and 6% filler. Rosin and alum were added at 17.5 Kg/ton and 50 Kg/T, respectively. By adding 1.5% anionic potato starch phosphate, headbox anionic demand decreased to 50 meq×$10^{-6}$/10 ml (i.e. headbox charge was +50 meq×$10^{-6}$/10 ml). The addition of anionic potato starch phosphate improved dewatering, gloss and dry tensile strength.

An article by McKague entitled *Practical Application of the Electrokinetics of Papermaking* in Tappi/December, 1974, Vol. 57, No. 12, p. 101, reviews the application of electrokinetics to photographic papermaking systems. Their experimental data shows that maximum wet and dry strength occur at −0.75 electrophoretic mobility when a small amount of anionic dry strength resin was added to the photographic papermaking system. The other ingredients in the system are cationic starch, cationic wet strength resin, anionic sizing material, and hydrolyzed aluminum salt. The amount of materials, the types of resins, and where they were added were not disclosed in the article.

An article by Patton & Lee entitled *Charge Analyses: Powerful Tools in Wet End Optimization* in 1993 Papermakers Conference Proceedings, p. 555, reviews charge analysis schemes: zeta potential, colloid titration ratios and charge demand titrations. The article states that zeta potential is an indirect indication of the density of charges on a particle surface; zeta potential and electrophoretic mobility are measurements of the same material characteristic; and zeta potential has the disadvantage of being ionic strength and temperature dependent. Patton et al. describes charge titration as the second major category of wet end charge analysis methods; however, Patton et al. dismisses charge titration as an effective method of predicting furnish response to wet end chemistries. Patton et al., while disclosing that either monitoring system can flag possible changes in machine performance and efficiency, clearly states that measurement of zeta potential is necessary to accurately predict system response to retention aids.

A case study is presented for the wet end of the alkaline fine paper machine using precipitated calcium carbonate filler, dual polymer retention systems, internal size, and wet end starch. Charge demand titrations showed that the wet end was cationic; the machine suffered considerable deposits which resulted in holes and breaks. The cationic donor in the dual polymer system was slowly reduced; sizing increased while headbox charge became slightly anionic −20 to −60 meq×$10^{-6}$/10 ml. The article by Patton & Lee focused on sizing systems.

An article by W. H. Griggs and B. W. Crouse entitled *Wet End Sizing—An Overview* in Tappi/June, 1980, Vol. 63, No. 6, p. 49, reviews the types of sizing materials and the interrelationship of sizing to electrokinetics, pH, and formation. They show that maximum wet and dry strength levels occur at −7 mv of zeta potential for a complicated wet end system containing dry strength agents, brighteners, dyes, size, $Al^{+3}$, and wet strength agents.

An article by E. E. Moore entitled *Drainage and Retention Mechanisms of Papermaking Systems Treated with Cationic Polymers* in Tappi/January, 1975, Vol. 58, No. 1, p. 99, shows that optimum drainage or retention of a papermaking system in which a drainage and retention aid is used does not necessarily correlate with the point of zero zeta potential of the substrate surface. In a bleached pulp system containing alum, drainage increases when zeta potential is increased by adding cationic polyacylamide. Furthermore, in a bleach pulp system containing 2 lb/T alum, the addition of 1 lb/T cationic polyacrylamide changed the zeta potential from 0 to +30 mv, while improving permeability by more than 50%. This data was generated with pulp samples refined in deionized water. The polymer treated samples (alum/cationic polyacylamide) were washed and used to measure streaming potential.

An article by E. Sandstrom entitled *First Pass Fines Retention Critical to Efficiency of Wet Strength Resin* in Paper Trade Journal/Jan. 30, 1979, p. 47, shows that optimum wet strength results were obtained at −6 mv headbox zeta potential for an amphoteric retention aid polymer and at −3 mv headbox zeta potential using a low molecular weight quaternary amine. He concludes that first pass retention can be increased for better wet strength resin performance through zeta potential suppression and through the use of high molecular weight polymers. This article also discloses negative effects of excessive use of retention aids (i.e. positive charge in the headbox): excessive yankee adhesion and felt filling.

An article by Dixit et al. incorporated herein by reference entitled *Retention Strategies for Alkaline Fine Papermaking*

*with Secondary Fiber: A Case History* in Tappi Journal, April, 1991, p. 107, reviews methods for measuring charge: zeta potential, colloidal titration ratio, and cationic demand. A case study was discussed showing schemes for improving first-pass retention in blue basestock. The highly anionic blue dye was causing system charge unbalance and adversely affecting first pass retention. A cationic low molecular weight, high charge density polyamine polymer was added to the machine chest for total retention and first pass ash retention improvements. System charge was reduced from −25 mv to −13 mv of zeta potential.

An article by C. King entitled *Charge and Paper Machine Operation* in 1992 Papermakers Conference Proceedings, p. 5, discusses four schemes for measuring charge: electrophoresis, streaming potential, streaming current, and colloidal titration with an end point color change. King does not distinguish one method versus another when describing charge in his article. While King does refer to charge, it is clear that King is, in fact, referring to zeta potential, quantities related to zeta potential or quantities related to the sign of the charge.

Edward Strazdin has written a number of articles discussing the measurement of mobility (related to zeta potential) on fiber furnishes. In the article Entitled *Factors Affecting Retention of Wet-End Additives* in Tappi, Vol. 53, No. 1, January, 1970, p. 80, Strazdin discusses the role of cationic long chain polymers on retention of emulsion-type sizing agents. He also discusses the colloidal and retention characteristics of melamine formaldehyde wet strength resin and how these characteristics are affected by electrokinetic charge. The experiments were laboratory Noble and Wood handsheet studies and mobility measurements were made on diluted thick stock samples after chemical addition. For a synthetic size based on a cellulose reactive stearic anhydride, the addition of a cationic polyamine caused sizing to maximize at zero mobility. Changing mobility with the addition of sulfate ion or ferricyanide ion led to a maximum in wet tensile strength as zero mobility was approached. Using carboxy methyl cellulose to vary mobility, maximum wet strength occurred at positive mobility, apparently due to particle size variation with charge density changes.

In the article entitled *Optimization of the Papermaking Process by Electrophoresis* in Tappi, July, 1977, Vol. 60, No. 7, p. 113, Strazdin shows that sizing and wet strength of a photographic grade paper were optimized by balancing, essentially to zero, the electrokinetic mobility through the neutralization of the cationic charge with anionic dry-strength resin. Fiber furnish was high-alpha cellulose bleached sulfite; fatty acid anhydride emulsion was used as the sizing agent; cationic polyamine-epichlorohydrin resin was used as the wet strength agent; and an anionic polyacylamide dry-strength agent was used to balance charge. Experiments were performed on handsheets. Mobility measurements were made on stock filtrate.

In the article entitled *Microelectrophoresis Theory and Practice* in 1992 Papermakers Conference Proceedings, p. 503, Stradzin shows the importance of microelectrophoresis for optimizing wet-end chemistry. A maximum in wet strength occurs at zero electrophoretic mobility where mobility was varied by adding a cationic promoter to a cationic polyacrylamide system contaminated with a constant level of anionic carboxy methyl cellulose. Another experiment shows that retention maximizes at zero zeta potential when zeta potential was varied by changing cationic guar gum levels. Stradzin criticizes non-zeta potential schemes for measuring wet end chemistry properties, e.g. pad techniques, CTR, saying that they produce results with varying degrees of deviation from the correct values.

In Chapter 4 of Wet Strength Resins and Their Applications (1994, Editor: L. Chan) entitled *Application of Electrokinetics in Optimization of Wet End Chemistry*, Strazdin thoroughly reviews techniques for measuring electrokinetic charge, e.g. zeta potential, streaming current detector, colloidal titration ratio, and cationic demand. He shows that wet tensile strength is a maximum at zero mobility for a cationic polyacrylamide resin containing varying levels of anionic carboxy methyl cellulose. In an article by Strazdin entitled, *Chemical Aids Can Offset Strength Loss in Secondary Fiber Furnish Use*, in Pulp & Paper, March, 1984, p. 73, analytical techniques for assessing the effectiveness of chemical additives for improving retention are discussed, including dual polymer retention aid systems. Furthermore, his results show that a dry strength resin is most efficient if added to a long fiber fraction versus a short fiber fraction.

U.S. Pat. No. 5,368,694 to Rohlf et al. discloses a method for controlling pitch deposition from aqueous pulp suspension having neutral or cationic charge defined as −100 meq$\times10^{-6}$/10 ml to +800 meq$\times10^{-6}$/10 ml. The method involves contacting the pulp suspension with a water soluble anionic polymer or anionic surfactant to change pulp suspension charge to at least −150 meq$\times10^{-6}$/10 ml without negatively effecting the quality of paper and further contacting the paper machine equipment surfaces with a water soluble cationic polymer or surfactant that has a charge density of at least 0.1 meq/g. U.S. Pat. No. 5,368,694 argues against maintaining pulp suspension charge from less than about 0 to −115 meq$\times10^{-6}$/10 ml and suggests that aqueous pulp suspension should be maintained at a soluble charge of at least −150 meq$\times10^{-6}$/10 ml, preferably increased to greater than −200 meq$\times10^{-6}$/10 ml and most preferably greater than −300 meq$\times10^{-6}$/10 ml.

U.S. Pat. No. 4,752,356 to Taggert et al. discloses a method for controlling cationic material additives in order to neutralize a papermaking slurry containing anionic contaminants using total organic carbon measurements of samples of slurry as an indicator of cationic demand. Taggert et al. discovered that TOC measurements of filtered papermaking slurry samples correlate with cationic demand of the slurry. They advocate measurement of TOC of slurry samples before final chemical addition. To set limits on TOC for optimal papermaking conditions would require a unique relationship between TOC and cationic charge. A unique relationship of TOC versus cationic demand is not demonstrated in the '356 patent.

The role of zeta potential or the closely related quantity, electrophoretic mobility, for wet end optimization has been a factor of much debate in the literature. Brouwers, previously cited, describes the results of pulp filtrate conductivity experiments where conductivity varied by adding $Na_2SO_4$. Brouwers states that, "[a]t low conductivity, a zeta potential of close to zero (e.g., −2 mv) would provide optimum papermaking conditions, because hardly any anionic trash is left (low cationic demand). However, at higher conductivities, disturbing amounts of anionic trash are still present at a zeta potential of −2 mv." Therefore, setting targets based on zeta potential can lead to conditions where cationic demand is either low or high. As determined in conjunction with the present invention, it is better to set targets based on the system charge.

Another example where setting limits on zeta potential for optimum papermaking conditions lead to system difficulties can be found in an article by Strazdin in Pulp & Paper, March, 1984, p. 73, previously cited. Strazdins discloses that the use of electrokinetic charge or mobility as the sole guideline is only applicable to furnishes that contain low levels of electrolytes, i.e. where the conductivity is low. Strazdins asserts that the arguments become different if the furnish contains high levels of dissolved electrolytes, i.e. the conductivity is high. In that case, the range of coulombic forces is greatly reduced and the magnitude of the mobility decreases to a low value regardless of the extent of stoichiometric charge balance and the amount of dissolved anionic contaminants in the aqueous phase. Strazdins thus suggests that it is difficult to set proper limits on zeta potential for optimum papermaking conditions.

The afore described literature is neither conclusive nor consistent in determining optimized zeta potentials. Based upon the prior art's widely varying optimums in zeta potentials, appropriate operating ranges have been difficult to predict.

The present invention overcomes disadvantages associated with the prior art by providing an effective means for producing a soft, absorbent, strong non-compacted away-from-home hand towel by combining refined long fiber with high levels of cationic wet strength resin/anionic dry strength agents where the cationic/anionic resins are varied so that headbox charge is controlled within a specified anionic range

SUMMARY OF THE INVENTION

Further advantages of the invention will be set forth in part in the description which follows and in part will be apparent from the description. The advantages of the invention may be realized and attained by means of the instrumentalities and combinations particularly pointed out in the appended claims.

To achieve the foregoing advantages and in accordance with the purpose of the invention, as embodied and broadly described herein, there is disclosed:

A method of forming an aqueous web comprising:

supplying to a headbox an aqueous stream comprising a major proportion of refined long fiber having an average weight-weighted fiber length of from at least about 2 mm to about 3.5 mm, and a minor portion of a second fiber selected from the group consisting of hardwood fibers, recycle fibers, secondary fibers, nonwoody fibers, eucalyptus fibers, high yield fibers, thermally curled fibers, thermally cross-linked bulking fibers, and mixtures thereof;

supplying to the aqueous stream a cationic wet strength agent selected from the group consisting of polyamide-epihalohydrin resins, thermosetting polyacrylamide resins, urea-formaldehyde resins, melamine formaldehyde resins, and mixtures thereof in an amount of from about 15 to about 30 lbs/ton of total fiber in the furnish;

supplying to the aqueous stream an anionic strength agent selected from the group consisting of carboxymethyl celluloses, carboxymethyl guar gums, anionic starches, anionic guar gums, anionic polyacrylamides and mixtures thereof;

measuring the total anionic charge carried by the aqueous stream;

controlling the amount of cationic wet strength agent and anionic strength agent so that the net charge of the aqueous stream in the headbox is maintained in the range of from less than about zero to about $-115$ meq$\times 10^{-6}$ per 10 ml;

depositing the aqueous stream on a first moving foraminous support to form a web;

non-compactively dewatering the web deposited on the first moving foraminous support to a consistency in the range of from about 10% to about 30%;

transferring the web to a second moving foraminous support;

drying the web to a consistency of at most about 98%;

removing the web from the foraminous support.

There is further disclosed:

A fibrous web comprising:

a major portion of refined long fiber having an average weight-weighted fiber length of from at least about 2 mm to about 3.5 mm;

a minor portion of a fiber selected from the group consisting of hardwood fibers, recycle fibers, secondary fibers, nonwoody fibers, eucalyptus fibers, high yield fibers, thermally curled fibers, thermally cross-linked bulking fibers, and mixtures thereof;

a cationic wet strength agent selected from the group consisting of polyamide-epihalohydrin resins, thermosetting polyacrylamide resins, urea-formaldehyde resins, melamine formaldehyde resins, and mixtures thereof in an amount of from about 15 to about 30 lbs/ton;

an anionic strength agent selected from, carboxymethyl celluloses, carboxymethyl guar gums, anionic starches, anionic guar gums, anionic polyacrylamides, and mixtures thereof;

the web having a machine direction stretch of at least about 8%, a cross-direction wet strength of at least about 29 g/3 in/lb of basis weight, and a tensile modulus of stiffness less than about 150 g/in-%.

There is still further disclosed:

A single ply towel product having a basis weight from 15 to 35 lb/rm; a geometric mean wet tensile strength from 500 to 2200 g/3 in; an absorbency from 125 to 400 g/m$^2$; and a tensile modulus of stiffness from 50 to 150 g/in-% made by a process comprising:

supply to a headbox an aqueous stream comprising a major proportion of refined long fiber having an average weight-weighted fiber length of from at least about 2 mm to about 3.5 mm, and a minor portion of a second fiber selected from the group consisting of hardwood fiber, recycled fiber, secondary fiber, nonwoody fibers, eucalyptus fibers, high yield fibers, thermally curled fibers, thermally cross-linked bulking fibers, and mixtures thereof;

supplying to the aqueous stream a cationic wet strength agent selected from the group consisting of polyamide-epihalohydrin resins, thermosetting polyacrylamide resins, urea-formaldehyde resins, melamine formaldehyde resins, and mixtures thereof in an amount of from about 15 to about 30 lbs/ton of the total fiber in the furnish;

supplying to the aqueous stream an anionic strength agent selected from the group consisting of carboxymethyl celluloses, carboxymethyl guar gums, anionic starches, anionic guar gums, anionic polyacrylamides, and mixtures thereof;

measuring the total anionic charge carried by the aqueous stream;

controlling the amount of cationic wet strength agent and anionic strength agent so that the net charge of the aqueous stream in the headbox is maintained in the range of from less than about zero to about $-115$ meq$\times 10^{-6}$ per 10 ml;

depositing the aqueous stream on a first moving foraminous support to form a web;

non-compactively dewatering the web deposited on the first moving foraminous support to a consistency in the range of from about 10% to about 30%;

transferring the web to a second moving foraminous support wherein the speed of the second moving foraminous support is at least about 2% less than the speed of the first moving foraminous support, thereby imparting a fabric crepe to the web of at least about 2%;

drying the web to a consistency of at least about 40%;

transferring the web to an internally heated drying cylinder;

removing the web from the internally heated drying cylinder by a creping step wherein the creping imparts a reel crepe to the web of at least about 2%;

embossing the web to a sufficient degree to reduce its tensile modulus of stiffness by at least 10%.

Finally, there is disclosed:

A single ply towel product having a basis weight from 15 to 35 lb/rm; a geometric mean wet tensile strength from 500 to 2200 g/3"; an absorbency from 125 to 400 g/m$^2$; and a tensile modulus of stiffness from 50 to 150 g/in-% made by a process comprising:

supplying to a headbox an aqueous stream comprising a major proportion of refined long fiber having an average weight-weighted fiber length of from at least about 2 mm to about 3.5 mm, and a minor portion of a second fiber selected from the group consisting of hardwood fibers, recycle fibers, secondary fibers, nonwoody fibers, eucalyptus fibers, high yield fibers, thermally curled fibers, thermally cross-linked bulking fibers, and mixtures thereof;

supplying to the aqueous stream a cationic wet strength agent selected from the group consisting of polyamide-epihalohydrin resins, thermosetting polyacrylamide resins, urea-formaldehyde resins, melamine formaldehyde resins, and mixtures thereof in an amount of from about 15 to about 30 lbs/ton of total fiber in the furnish;

supplying to the aqueous stream an anionic strength agent selected from the group consisting of carboxymethyl celluloses, carboxymethyl guar gums, anionic starches, anionic guar gums, anionic polyacrylamides, and mixtures thereof;

measuring the total anionic charge carried by the aqueous stream;

controlling the amount of cationic wet strength agent and anionic strength agent so that the net charge of the aqueous stream in the headbox is maintained in the range of from less than about zero to about $-115$ meq$\times 10^{-6}$ per 10 ml;

depositing the aqueous stream on a first moving foraminous support to form a web;

non-compactively dewatering the web deposited on the first moving foraminous support to a consistency in the range of from about 10% to about 30%;

transferring the web to a second moving foraminous support;

drying the web to a consistency of at most about 98%;

removing the web from the foraminous support.

The accompanying drawings, are included to provide a further understanding of the invention and are incorporated in and constitute a part of the specification. The drawings illustrate embodiments of the invention and, together with the description, serve to explain the principles of the invention.

BRIEF DESCRIPTION OF THE DRAWINGS

FIG. 10 illustrates the relationship between wet geometric mean breaking length and headbox titratable charge for PAE/CMC systems.

FIG. 11 illustrates the relationship between wet geometric mean breaking length and headbox streaming current for PAE/CMC systems.

DETAILED DESCRIPTION

Figure 1:
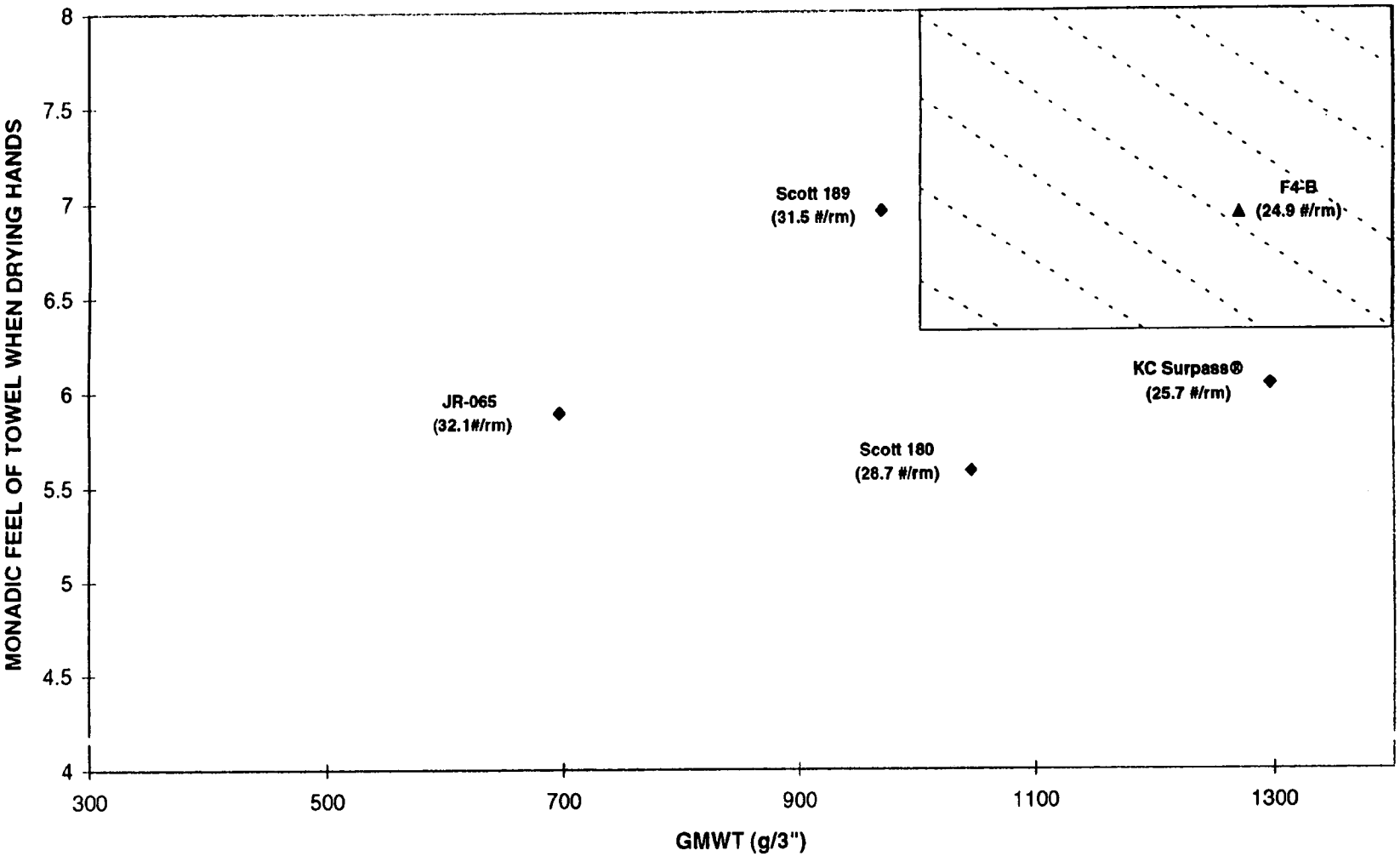
FIG. 1 illustrates the relationship between monadic feel of towel when drying hands and geometric mean wet tensile strength.

The present invention is a fibrous web having improved strength, softness, and absorbency. The web is formed by supplying to a headbox an aqueous stream containing fiber to form a furnish. The stream preferably contains as its major component a fiber having an average weight-weighted fiber length of at least about 2 mm to about 3.5 mm, more preferably from about 2.2 mm to about 3.2 mm and most preferably from about 2.4 to about 2.8 mm. As used in the present application the term "major component" refers to an amount of 50% by weight or more. Preferred amounts of this long fiber are greater than about 60% and most preferred amounts are greater than 70%.

The wood fibers contained in the major component of the furnish in the present invention are liberated in the pulping process from gymnosperms or coniferous trees. The particular coniferous tree and pulping process used to liberate the tracheid are not critical to the success of the present invention. The papermaking fibers can be liberated from their source material by any of a number of chemical pulping processes familiar to the skilled artisan including sulfate, sulfite, polysulfite, soda pulping, and the like. The pulp can be bleached if desired by chemical means, including for example, the use of chlorine, chlorine dioxide, oxygen and the like. Furthermore, papermaking fibers can be liberated from source material by any one of a number of mechanical/chemical pulping processes familiar to the skilled artisan including mechanical pulping, thermo-mechanical pulping, and chemi-thermomechanical pulping. These mechanical pulps can be bleached, if desired, by a number of familiar techniques including but not limited to alkaline peroxide and ozone bleaching. The fibers of the major component of the furnish are preferably selected from softwood kraft fibers, preferably northern softwood kraft fibers, and mixtures containing as a major portion northern softwood kraft fiber.

The web of the present invention also contains a minor component pulp. These minor component wood fibers are liberated in the pulping process from angiosperms or deciduous trees. The particular deciduous tree and pulping process used to liberate the tracheid are not critical to the success of the present invention. For example, the papermaking fibers can be liberated from their source material by any one of the number of chemical pulping processes familiar to a skilled artisan including sulfate, sulfite, polysulfite, soda pulping, etc. The pulp can be bleached if desired by chemical means including the use of chlorine dioxide, chlorine, oxygen, etc. Furthermore, papermaking fibers can be liberated from source material by any one of a number of mechanical/chemical pulping processes familiar to the skilled artisan including mechanical pulping, thermo-mechanical pulping, and chemi-thermomechanical pulping. These mechanical pulps can be bleached, if desired, by a number of familiar techniques including but not limited to alkaline peroxide and ozone bleaching. Besides using pulp generated from deciduous trees, the minor component pulp can come from diverse material origins including recycle or secondary fibers, eucalyptus and non-woody fibers liberated from sabai grass, rice straw, banana leaves, paper mulberry (i.e., bast fiber), abaca leaves, pineapple leaves, esparto grass leaves, and plant material from the genus hesperolae in the family agavaceae. Preferred nonwoody fibers include those disclosed in U.S. Pat. Nos. 5,320,710, 3,620,911 and Canadian Patent No. 2,076,615, which are incorporated herein by reference. Finally, papermaking fibers can be thermally curled and thermally cross-linked, if desired.

This fiber is supplied to the headbox as a minor portion of the aqueous stream containing the longer fiber or can be supplied separately. As used in the present application the term "minor component" refers to an amount 50% or less. Preferred amounts of this minor component pulp are less than about 40% and the most preferred amounts are less than 30%.

The web of the present invention also preferably contains a cationic thermally-curing, wet-strength-adjusting agent. A non-exhaustive list of cationic wet-strength-adjusting agents includes polyamide epihalohydrin, alkaline-curing wet strength resins; polyacrylamide, alkaline-curing wet strength resins; urea formaldehyde, acid-curing wet strength resins; and melamine-formaldehyde, acid-curing wet strength resins. A reasonably comprehensive list of wet strength resins is described by Westfelt in *Cellulose Chemistry and Technology*, Volume 13, p. 813, 1979, which is incorporated herein by reference.

Thermosetting cationic polyamide resins are reaction products of an epihalohydrin and a water soluble polyamide having secondary anionic groups derived from polyalkylene polyamine and saturated aliphatic dibasic carboxylic acids containing from 3 to 10 carbon atoms. These materials are relatively low molecular weight polymers having reactive functional groups such as amino, epoxy, and azetidinium groups. Description of processes for making such materials are included in U.S. Pat. Nos. 3,700,623 and 3,772,076, both to Keim and incorporated herein by reference in their entirety. A more extensive description of polymeric-epihalohydrin resins is given in Chapter 2*: Alkaline-Curing Polymeric Amine-Epichlorohydrin* by Espy in *Wet-Strength Resins and Their Application* (L. Chan, Editor, 1994), herein incorporated by reference in its entirety. The resins described in this article fall within the scope and spirit of the present invention. Polyamide-epichlorohydrin resins are commercially available under the tradename KYMENE® from Hercules Incorporated and CASCAMID® from Borden Chemical Inc.

Thermosetting polyacrylamides are produced by reacting acrylamide with diallyl dimethyl ammonium chloride (DADMAC) to produce a cationic polyacrylamide copolymer which is ultimately reacted with glyoxal to produce a cationic cross-linking wet strength resin, glyoxylated polyacrylamide. These materials are generally described in U.S. Pat. No. 3,556,932 to Coscia et al. and U.S. Pat. No. 3,556,933 to Williams et al., both of which are incorporated herein by reference in their entirety. Resins of this type are commercially available under the tradename of PAREZ 631NC by Cytec Industries. Different mole ratios of acrylamide/DADMAC/glyoxal can be used to produce cross-linking resins which are useful in the present invention. Furthermore, other dialdehydes can be substituted for glyoxal to produce thermosetting wet strength characteristics. The use of wet strength resins with the above variations fall within the scope and spirit of the present invention.

Preferred cationic strength adjusting agents include polyamide-epihalohydrin resins, polyacrylamide resins, urea-formaldehyde resins and melamine formaldehyde resins. The cationic strength adjusting agent is preferably selected from polyamide-epihalohydrin resins such as KYMENE® and CASCAMID® and glyoxylated polyacrylamides, and is most preferably selected from polyamide epichlorohydrin resins. The cationic strength adjusting agent is preferably added in an amount of at least about 15 to about 30 lbs/T, more preferably from about 20 to 30 lbs/T, and most preferably about 25 to 30 lbs/T.

The web of the present invention also preferably includes an anionic strength adjusting agent. Preferred anionic strength adjusting agents are selected from the group consisting of carboxymethyl cellulose (CMC) with various degrees of substitution and molecular weight, including CMC-7LT®, CMC-7HT®, CMC-12MT®, CMC-7MT® from Hercules; carboxymethyl guar (CMG) with various degrees of substitution and molecular weight, including GALACTASOL SP722S® from Hercules; anionic starch, including REDIBOND 3030® from National Starch; anionic guar gums; and polyacrylamides, including ACCOSTRENGTH 771® and ACCOSTRENGTH 514® from Cytec Industries. The anionic strength adjusting agent is more preferably selected from carboxymethyl cellulose and carboxymethyl guar and is most preferably selected from carboxymethyl cellulose.

The cationic and anionic strength adjusting agents are added so that the net charge of the aqueous stream at the headbox is maintained in the range of from less than about zero to about $-115$ meq$\times 10^{-6}$ per 10 ml. More preferably, the net charge is from less than about zero to $-50\times 10^{-6}$ per 10 ml. Still more preferably, the net charge is from about $-5$ meq$\times 10^{-6}$ per 10 ml to about $-100$ meq$\times 10^{-6}$ per 10 ml, and most preferably, the net charge is from about $-10$ meq$\times 10^{-6}$ per 10 ml to about $-100$ meq$\times 10^{-6}$ per 10 ml.

In preferred embodiments of the present invention the net charge on the aqueous stream at the headbox is measured and controlled. The net charge on the headbox furnish may be measured periodically using a polyelectrolyte titration with streaming current used as an end point, for example, Mutek Model PDC-02 or PDC-03. Other methods for determining the titratable charge on the aqueous stream will be evident to the skilled artisan, for example, polyelectrolyte titrations can use electrophoretic mobility to determine endpoint or a color indicator like O-toluidine blue to determine end point. Other standardized positive and negative charged agents besides DADMAC or PVSK can be used.

In one preferred embodiment of the present invention, titration is carried out using an automatic titrator from Mettler such as models DL 12 or DL 21, and a Mutek model PCD-02 particle charge detector to determine the end-point. According to this embodiment, a sample of the furnish from the headbox would be filtered through an 80 mesh screen to remove the long fibers. 10 mls of this filtrate would then be transferred to the piston cup assembly of the Mutek PCD-02 particle charge detector and titrated with standardized DADMAC or PVSK reagent. The end point would be taken at zero streaming current as indicated by the Mutek PCD-02. Net charge is reported as meq$\times 10^{-6}$ per 10 mls of sample. Titrations should be carried out within 20 minutes of taking the sample. Standardized PVSK (polyvinylsulfonate potassium salt) and DADMAC (poly diallyldimethyl ammonium chloride) can be obtained from Nalco Chemical Co., Field Systems Department, 6233 W. 65th Street, Chicago, Ill. 60638.

Once strength adjusting agents have been added to the furnish and it is at a slightly anionic charge, the fiber slurry is preferably deposited onto a foraminous support or forming fabric from a forming structure. The forming structure can be a twin wire former, a crescent former or any art recognized forming configuration. The particular forming structure is not critical to the success of the present invention. The forming fabric can be any art recognized foraminous member including single layer fabrics, double layer fabrics, triple layer fabrics, photopolymer fabrics, and the like. Non-exhaustive background art in the forming fabric area include U.S. Pat. Nos. 4,157,276; 4,605,585; 4,161,195; 3,545,705; 3,549,742; 3,858,623; 4,041,989; 4,071,050; 4,112,982; 4,149,571; 4,182,381; 4,184,519; 4,314,589; 4,359,069; 4,376,455; 4,379,735; 4,453,573; 4,564,052; 4,592,395; 4,611,639; 4,640,741; 4,709,732; 4,759,391; 4,759,976; 4,942,077; 4,967,085; 4,998,568; 5,016,678; 5,054,525; 5,066,532; 5,098,519; 5,103,874; 5,114,777; 5,167,261; 5,199,467; 5,211,815; 5,219,004; 5,245,025; 5,277,761; 5,328,565; and 5,379,808 all of which are incorporated herein by reference in their entirety. The particular forming fabric is not critical to the success of the present invention. Forming fabrics found particularly useful with the present invention are Appleton Mills Forming Fabric 852 and 2160 made by Appleton Mills Forming Fabric Corporation, Florence, Miss.

On the forming fabric the web is non-compactively dewatered to a consistency from about 10% to about 30%, more preferably from about 15% to about 25% and most preferably greater than about 20%. Dewatering is accomplished through vacuum dewatering with a steam shroud or by other art recognized methods. A non-exhaustive list includes capillary dewatering described in U.S. Pat. No. 4,556,450 and foam assisted dewatering described in U.S. Pat. No. 4,606,944. These patents are incorporated herein by reference in their entirety.

The web is then transferred from the first foraminous support to a second foraminous support. The two supports may be run at the same or different speeds. If the first foraminous fabric is run at a higher speed than the second foraminous fabric, this is referred to as fabric-fabric creping because it can be used in a manner similar to traditional creping to modify the physical characteristics of the web. Preferably, the speed differential is at least about 2%, more preferably at least about 5%, and most preferably the speed differential between the two forming supports is at least about 10%.

The transfer of the web from the first foraminous support to the second foraminous support is accomplished by any art recognized means, including for example the use of a vacuum transfer box.

The nascent web is dried on the second foraminous structure to a consistency of at least about 40%, more preferably at least about 50% and most preferably at least about 65%. Drying is preferably accomplished by the passage of heated air through both the web and the through-air-drying fabric, although any art recognized scheme for drying the web can be used. U.S. Pat. No. 3,432,936 (Reissue 28,459), U.S. Pat. Nos. 5,274,930; and 3,303,576, each disclose through-air-drying systems and each are incorporated herein by reference, in their entirety.

The second foraminous fabric is frequently referred to as a through-air-dryer fabric. The type of through-air-dryer fabric is not critical to the invention. Any art recognized fabrics can be used with the present invention. For example, a non-exhaustive list would include plain weave fabrics described in U.S. Pat. No. 3,301,746; semi twill fabrics described in U.S. Pat. Nos. 3,974,025 and 3,905,863; bilaterally-staggered-wicker-basket cavity type fabrics described in U.S. Pat. Nos. 4,239,065 and 4,191,609; sculptured/load bearing layer type fabrics described in U.S. Pat. No. 5,429,686; photopolymer fabrics described in U.S. Pat. Nos. 4,529,480, 4,637,859, 4,514,345, 4,528,239, 5,364,504, 5,334,289, 5,275,700, and 5,260,171; and fabrics containing diagonal pockets described in U.S. Pat. No. 5,456,293. The aforementioned list of patents are incorporated herein by reference, in their entirety.

The web can be removed directly from the second foraminous structure without creping. As an alternative, the web may be adhered to the surface of a Yankee drying cylinder. The web can be dried to a consistency of at least about 96% and then creped from the surface of the Yankee.

Suitable adhesives for adhering the web to the Yankee dryer include polyvinyl alcohol with suitable plasticizers, glyoxylated polyacrylamide with or without polyvinyl alcohol, and polyamide epichlorohydrin resins such as Quacoat A-252 (QA252), Betzcreplus 97 (Betz+97) and Calgon 675 B. Suitable adhesives are widely described in the patent literature. A comprehensive but non-exhaustive list includes U.S. Pat. Nos. 5,246,544; 4,304,625; 4,064,213; 3,926,716; 4,501,640; 4,528,316; 4,788,243; 4,883,564; 4,684,439; 5,326,434; 4,886,579; 5,374,334; 4,440,898; 5,382,323; 4,094,718; 5,025,046; and 5,281,307 which are incorporated herein by reference. Typical release agents can be used in accordance with the present invention.

Creping of the sheet can be made by any conventional creping means. Any art recognized creping apparatus can be used with the present invention and is not critical to the success of the present invention. Suitable creping apparatus is described in U.S. Pat. Nos. 4,192,709; 4,802,928; 4,919,756; 5,403,446; 3,507,745; 4,114,228; 2,610,935; 3,017,317; 3,163,575; 3,378,876; 4,432,927; 4,906,335; 4,919,877; 5,011,574; 5,032,229; 5,230,775 which are incorporated herein by reference. Further creping apparatus that may be used with the present invention is described in Ser. No. 08/320,711, filed Oct. 11, 1994, Ser. No. 08/359,318, filed Dec. 16, 1994, and Ser. No. 08/532,120, filed Sep. 22, 1995 entitled, "Biaxially Undulating Tissue and Creping Process using Undulatory Blade," which are incorporated herein by reference.

The web is preferably creped to impart a reel crepe of at least about 2%, more preferably at least about 5%, most preferably at least about 8%.

The web is preferably monitored as it is generated. In one preferred embodiment, one or more of the tensile modulus of stiffness, machine direction stretch and tensile strength are monitored and the following process variables modified to maintain the preferred product ranges:

1) the degree of refining imparted to the long fiber component of the furnish;
2) the overall fiber composition of the furnish;
3) the amount of cationic wet strength agent supplied to the aqueous stream;
4) the amount of anionic dry strength agent supplied to the aqueous stream;
5) the amount of fabric crepe imparted to the nascent web;
6) the amount of reel crepe imparted to the dried web; and
7) the severity of embossing to the dried web.

Products produced according to the present invention preferably exhibit characteristics within the following ranges:

| | |
|---|---|
| Conditioned Basis Weight (lb/rm) | 15–35 |
| Caliper (mils/8 sheet) | 70–150 |
| MD Dry Tensile (g/3 in) | 3000–8000 |
| CD Dry Tensile (g/3 in) | 2200–7500 |
| (Geometric Mean) GM Dry Tensile (g/3 in) | 2700–7800 |
| MD Stretch (%) | 5–25 |
| MD Wet Tensile (g/3 in) | 600–2400 |
| CD Wet Tensile (g/3 in) | 450–2000 |
| GM Wet Tensile (g/3 in) | 500–2200 |
| CD Wet/Dry Tensile Ratio (%) | 20–40 |
| Adsorbency (g/m$^2$) | 125–400 |
| GM Tensile modulus of stiffness (g/3 in-%) | 50–150 |

After removal of the dried web, the web can be processed directly but is generally wound to a reel and then embossed in a separate process. The embossing process of the present invention can include any conventional process understood by the skilled artisan. Preferred emboss schemes used with the present invention are disclosed, for example, in U.S. Pat. No. 5,458,950, incorporated herein by reference in its entirety. In the prior art, the aforementioned emboss patterns are named as the "BEC" & "Quilt" patterns. The design of the emboss pattern is not critical to the invention and selection of an appropriate emboss pattern would be well understood by the skilled artisan.

The product of the present invention can be prepared as a stratified or non-stratified product.

The following examples are not to be construed as limiting the invention as described herein.

EXAMPLE 1

An aqueous stream of furnish containing long fibers having weight-weighted fiber length of 2.6 mm was combined with 28 lbs/T of Kymene 557 LX (tradename for polyamide-epichlorohydrin resin sold by Hercules Incorporated of Wilmington, Del.) and 3.8 lbs/T of carboxylmethyl cellulose (CMC-7MT sold by Hercules Incorporated of Wilmington, Del.). The charge in the furnish at the headbox was −11.1 meq×10$^{-6}$ per 10 mls. The aqueous slurry was formed into a nascent web with an S-wrap twin wire forming apparatus at 1820 feet per minute. The web was transferred to a single layer through-air-dryer (TAD) fabric having a series of compressed and non-compressed areas. The web was transferred from the TAD fabric and adhered to and creped from a Yankee dryer. The dryer speed was 1755 feet/min.

The product was embossed using a quilt pattern described in U.S. Pat. No. 5,458,950. The product attributes are set forth in Table 1, as shown below.

Absorbency was determined using the following method. The sample table was set a finite distance above a reservoir of water, typically 1.5 cm. The water reservoir rests on a digital balance so that changes in weight due to water removal from the reservoir by absorption in the sample can be monitored and recorded. A round 50 mm sample was placed on the sample table over a 3 mm diameter hole which is connected to the water reservoir by a rubber tube. The table is quickly lowered and then raised to 1.5 cm to initially wet the sample. The capillary action of the sample draws water out of the reservoir. While the sample is absorbing water, the instrument is intermittently storing weight and time data. The termination criteria are set at less than 0.001 g change in sample weight over a thirty second time interval. At the end of the test, the instrument transmits the data to an attached computer. An appropriate computer program performs the necessary calculations and displays the results.

Tensile modulus of stiffness is measured on a Sintech 1S Computer Integrated Testing System using a one inch specimen width, a four inch gauge length, and 0.5 in/min crosshead speed. The tensile modulus of stiffness is the ratio of load to stretch at 100 gms of load.

Product attributes are often best evaluated using test protocols in which a consumer uses and evaluates a product. In a "monadic" test, a consumer will use a single product and evaluate its characteristics using a standard scale. Sensory softness is a subjectively measured tactile property that approximates consumer perception of sheet softness in normal use. Softness is usually measured by 20 trained panelists and includes internal comparison among product samples. The results obtained are statistically converted to a useful comparative scale.

TABLE 1

| | EXAMPLE 1 (F4-B) |
|---|---|
| Finished Product Properties: | |
| Basis Weight (lb/rm) | 24.9 |
| Caliper (mils/8 shts) | 101.5 |
| MDWT (g/3") | 1753 |
| CDWT (g/3") | 921 |
| GMWT (g/3") | 1271 |
| MDDT (g/3") | 5462 |
| CDDT (g/3") | 2578 |
| GMDT (g/3") | 3753 |
| Tensile modulus of stiffness (g/in-%) | 89.6 |
| Absorbency (g/m$^2$) | 189.7 |
| Consumer Test Results: | |
| Sensory Softness | 1.23 |
| Monadic Feel of Towel When Drying Hands | 6.93 |
| Monadic Speed of Absorbency When Drying Hands | 6.91 |
| Monadic Thoroughness of Hand Drying | 7.81 |
| Monadic Overall | 7.02 |

EXAMPLES 2-3

Examples 2 and 3 were carried out in the same manner as Example 1 except the conditions were as set forth in Table 2 below.

TABLE 2

| | EXAMPLE 2 (MH-7) | EXAMPLE 3 (MH-8) |
|---|---|---|
| Machine Conditions: | | |
| Forming Speed (fpm) | 1861 | 1862 |
| Yankee Speed (fpm) | 1800 | 1800 |
| Reel Speed (fpm) | 1688 | 1688 |
| TAD Inlet Temp (F.) | 445 | 443 |
| Post TAD Solids (%) | — | 65.4 |
| WSR (lbs/T) | 28 | 28 |
| CMC (lbs/T) | 4 | 4 |
| TAD Fabric Type | Asten 938X | Asten 938X |
| Titer HB (meq × 10$^{-6}$/10 ml) | 7.3 | 2.5 |
| Furnish | Long Fiber | Long Fiber |
| Broke (%) | 25 | 25 |

TABLE 2-continued

| | EXAMPLE 2 (MH-7) | EXAMPLE 3 (MH-8) |
|---|---|---|
| Calendering | Calendered | Uncalendered |
| Finish Product Properties: | | |
| Basis Weight (lb/rm) | 24.6 | 24.0 |
| Caliper (mils/8 shts) | 92.4 | 94.6 |
| MDWT (g/3") | 1590 | 1574 |
| CDWT (g/3") | 940 | 929 |
| Converting Process Conditions: | | |
| Emboss Design | I-8306 - 50% Align Center Float | I-8306 - 50% Align Center Float |
| Penetration (mils) | 18 | 18 |
| Calender Gap (mils) | 12 | 12 |
| Consumer Tests: | | |
| Sensory Softness | 1.25 | 0.55 |

In product evaluation, significant information can be obtained by forming comparisons including both subjective and objective product attributes. FIG. 1 is a plot of the relationship between the scalar rating of the subjective feel of a towel in a monadic test versus the geometric mean wet tensile strength. A towel product according to the present invention is labelled F4-B. For comparison purposes, the same data has been plotted for single-ply KC Surpass® 50000, Scott 180, Scott Select® 189 and of one James River's current commercial single-ply folded towel products.

Figure 2:
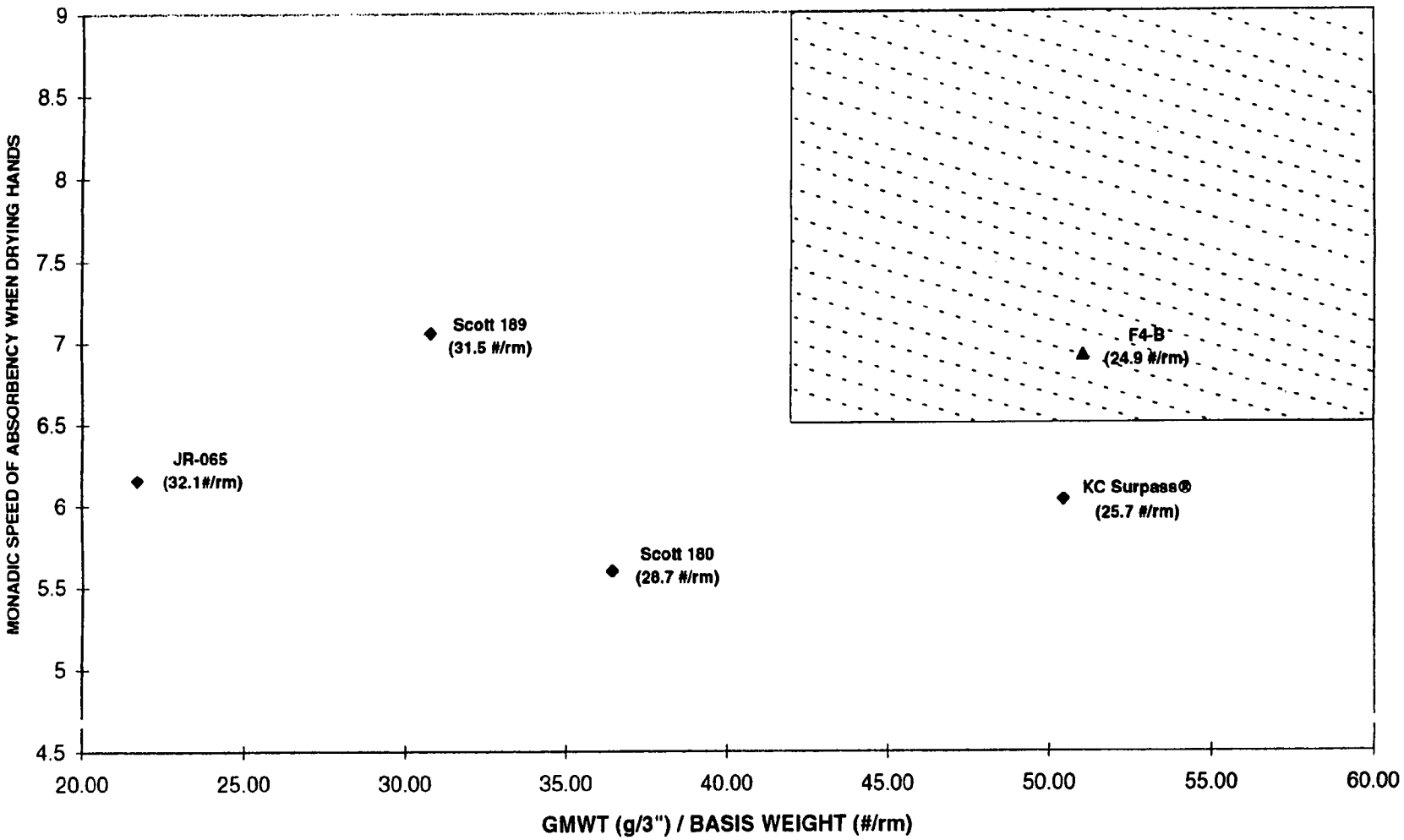
FIG. 2 illustrates the relationship between monadic speed of absorbency when drying hands and geometric mean wet tensile strength per unit basis weight.

FIG. 2 is a plot of the relationship between the scalar rating of the subjective speed of absorbency of a towel in a monadic test versus the geometric mean wet tensile strength per unit of basis weight. A towel product according to the present invention is labelled F4-B. For comparison purposes, the same data has been plotted for single-ply KC Surpass® 50000, Scott 180, Scott Select® 189 and one of James River's current commercial single-ply folded towel products.

Figure 3:
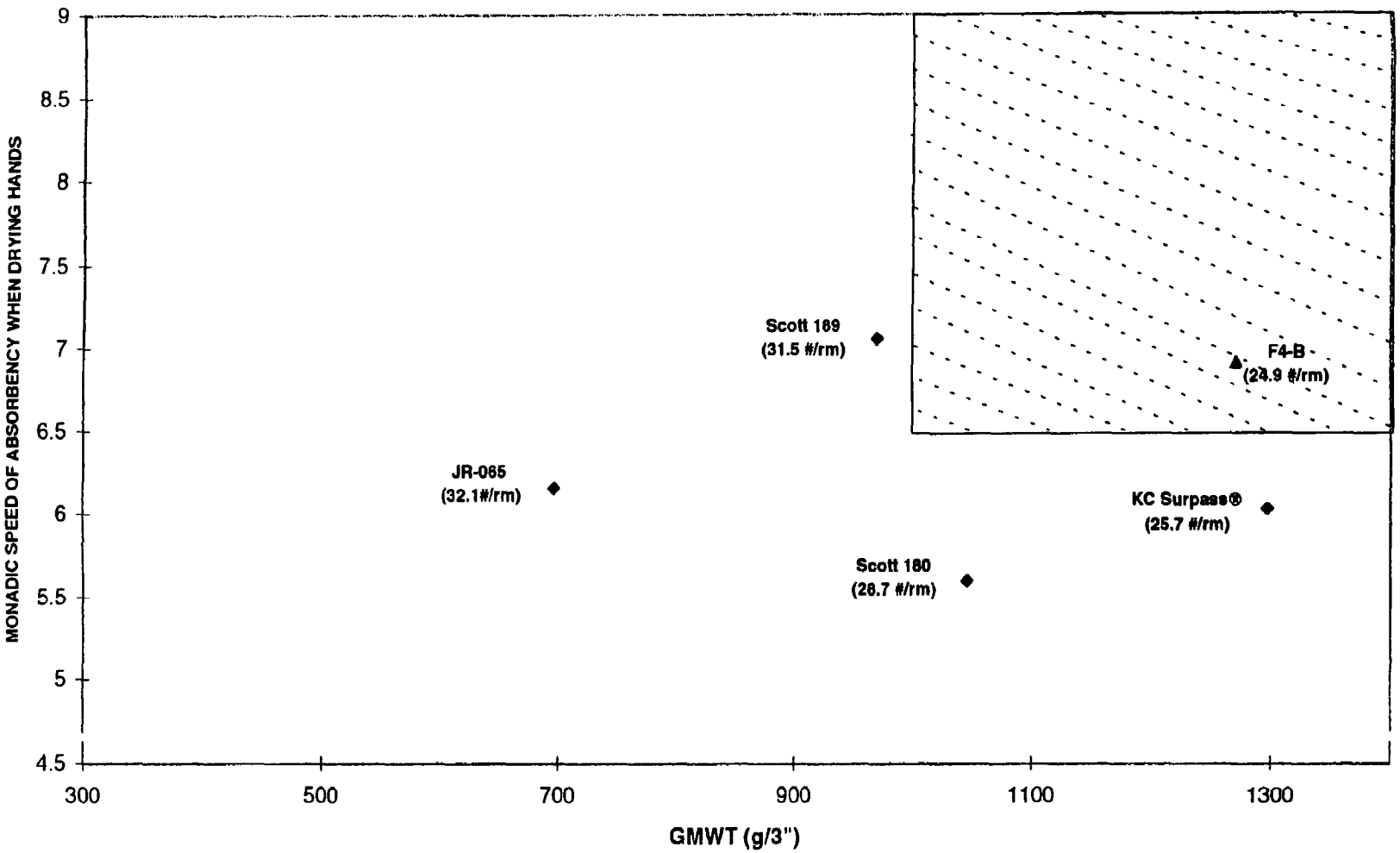
FIG. 3 illustrates the relationship between monadic speed of absorbency when drying hands and the geometric mean wet tensile strength.

FIG. 3 is a plot of the relationship between the scalar rating of the subjective speed of absorbency of a towel in a monadic test versus the geometric mean wet tensile strength. A towel product according to the present invention is labelled F4-B. For comparison purposes, the same data has been plotted for single-ply KC Surpass® 50000, Scott 180, Scott Select® 189 and one of James River's current commercial single-ply folded towel products.

Figure 4:
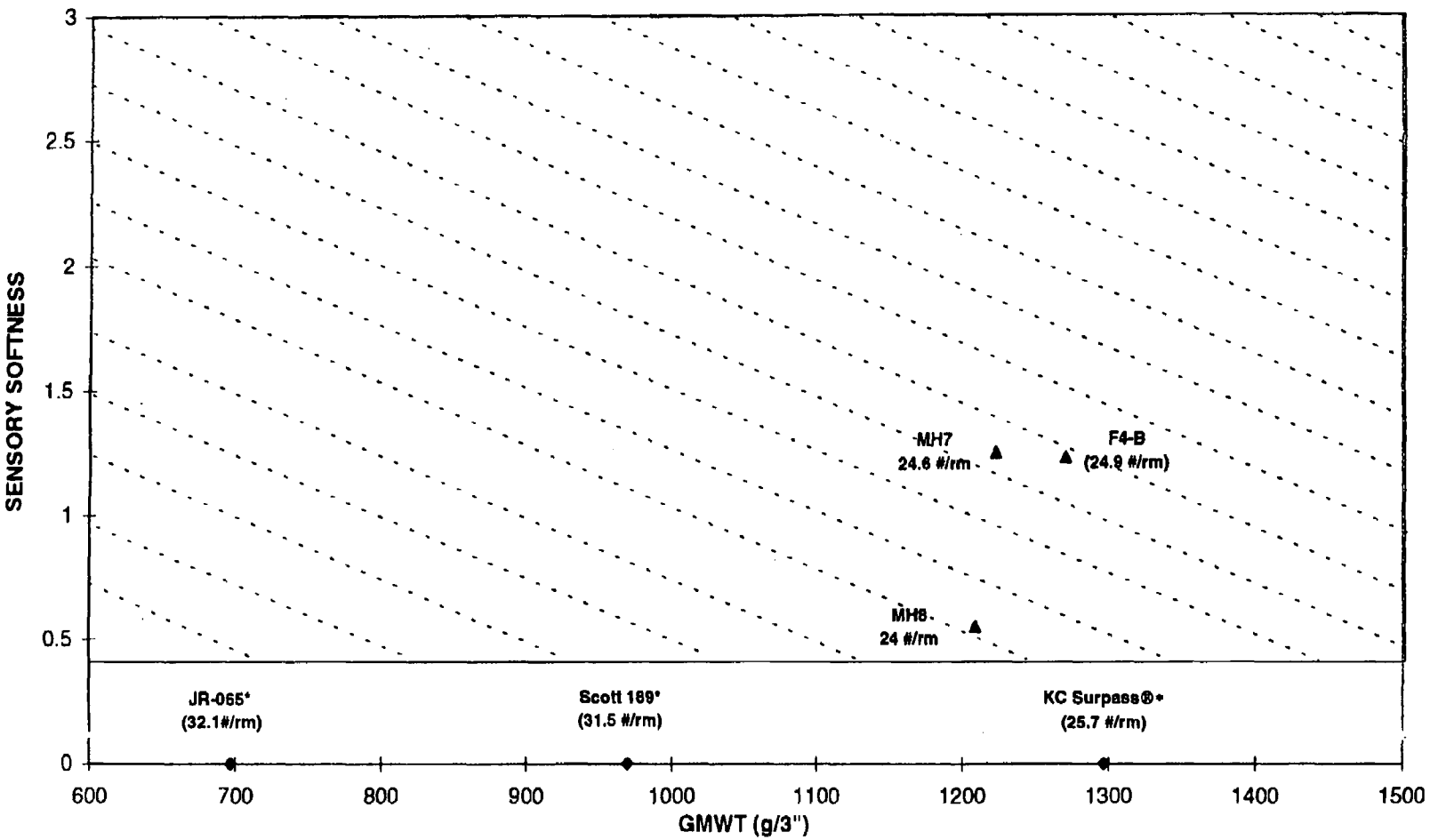
FIG. 4 illustrates the relationship between sensory softness and geometric mean wet tensile strength.

FIG. 4 is a plot of the relationship between the rating of the subjective sensory softness test versus the geometric mean wet tensile strength. Towel products according to the present invention are labelled F4-B, MH7 and MH8. For comparison purposes, the same data has been plotted for single-ply KC Surpass® 50000, Scott Select® 189 and one of James River's current commercial single-ply folded towel products.

Figure 5:
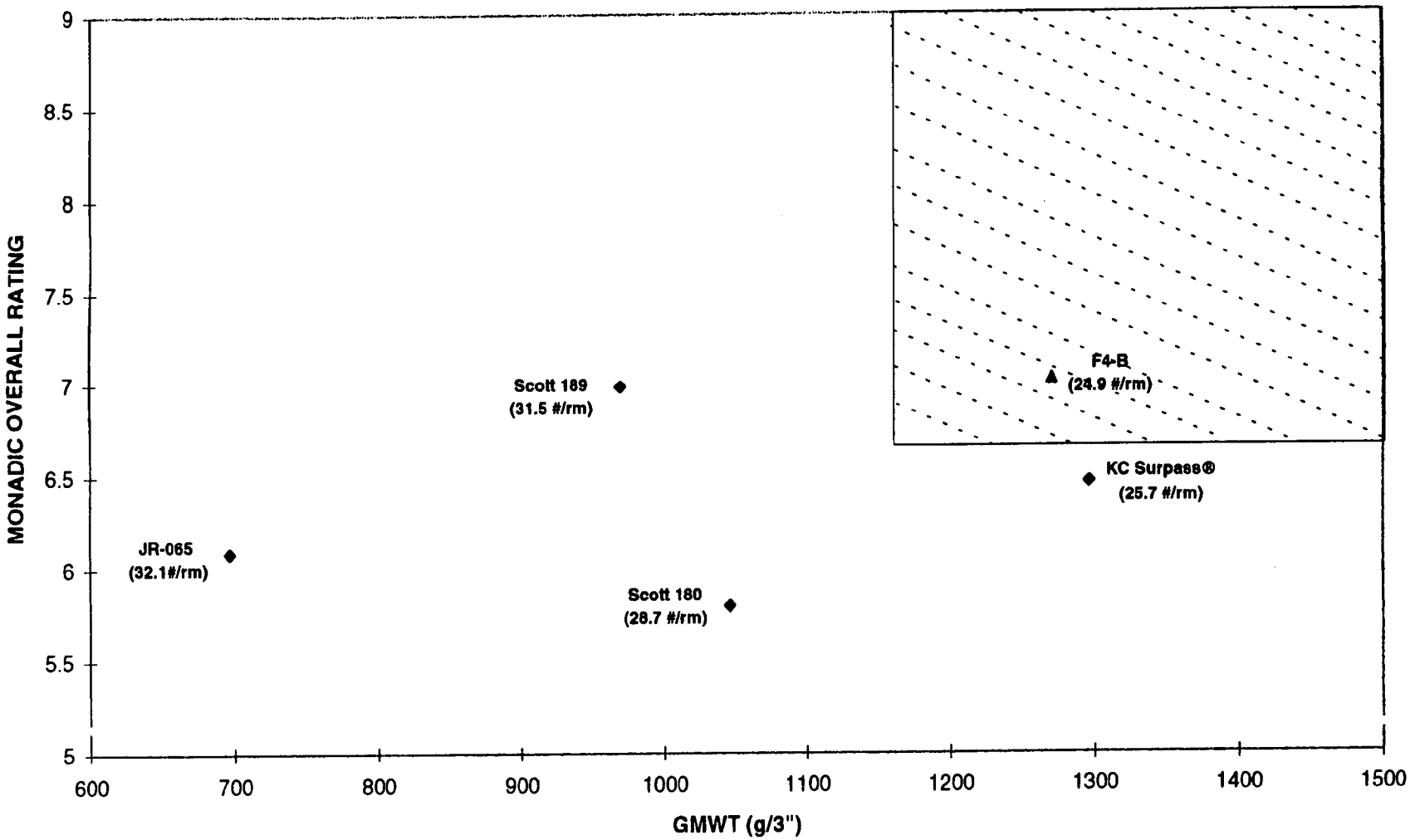
FIG. 5 illustrates the relationship between monadic overall rating and geometric mean wet tensile strength.

FIG. 5 is a plot of the relationship between the scalar rating of the overall subjective perception of a towel in a monadic test versus the geometric mean wet tensile strength. A towel product according to the present invention is labelled F4-B. For comparison purposes, the same data has been plotted for single-ply KC Surpass® 50000, Scott 180, Scott Select® 189 and one of James River's current commercial single-ply folded towel products.

Figure 6:
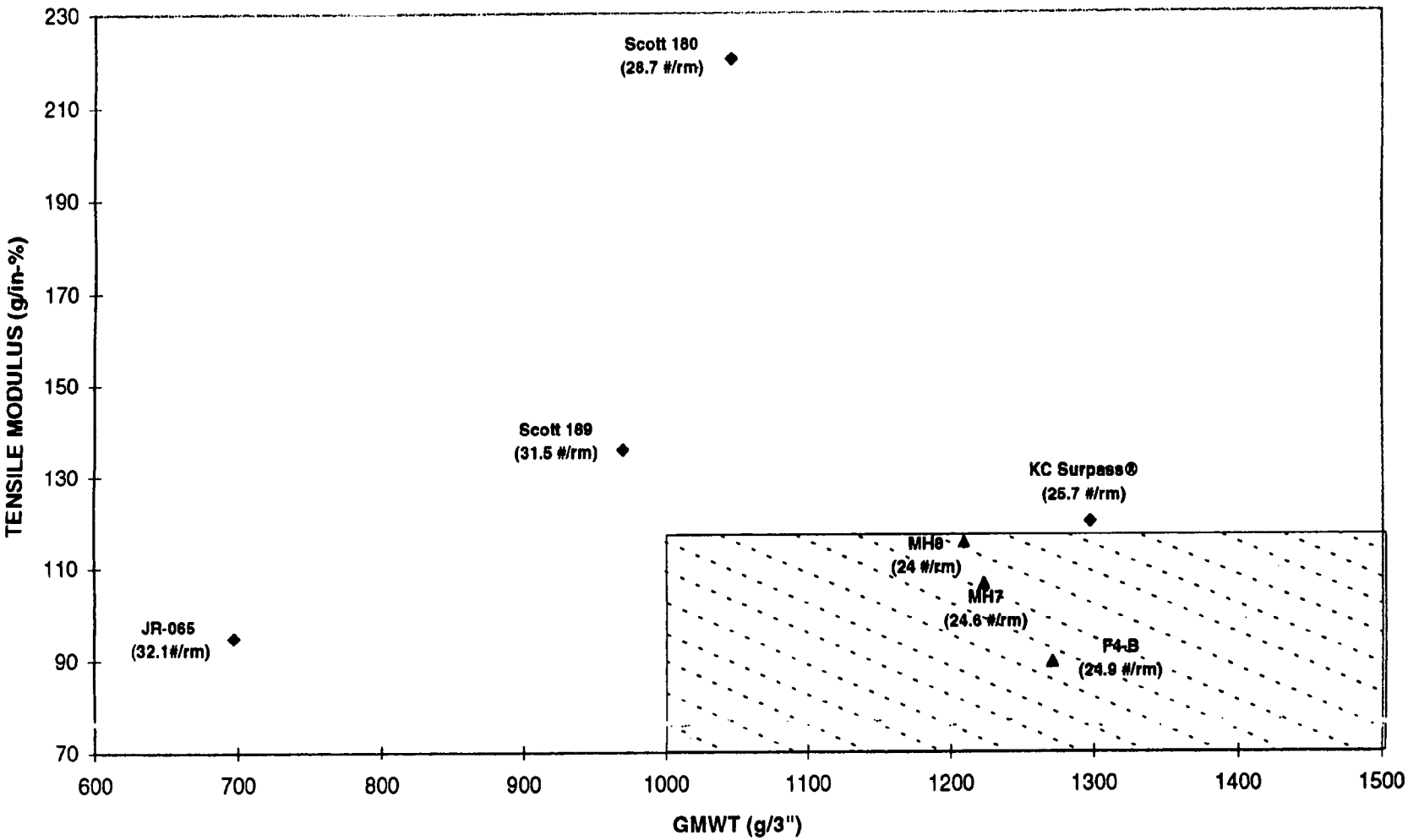
FIG. 6 illustrates the relationship between tensile modulus of stiffness and geometric mean wet tensile strength.

FIG. 6 is a plot of the tensile modulus of stiffness versus the geometric mean wet tensile strength. Towel products according to the present invention are labelled F4-B, MH7 and MH8. For comparison purposes, the same data has been plotted for single-ply KC Surpass® 50000, Scott 180, Scott Select® 189 and one of James River's current commerical single-ply folded towel products.

Figure 7:
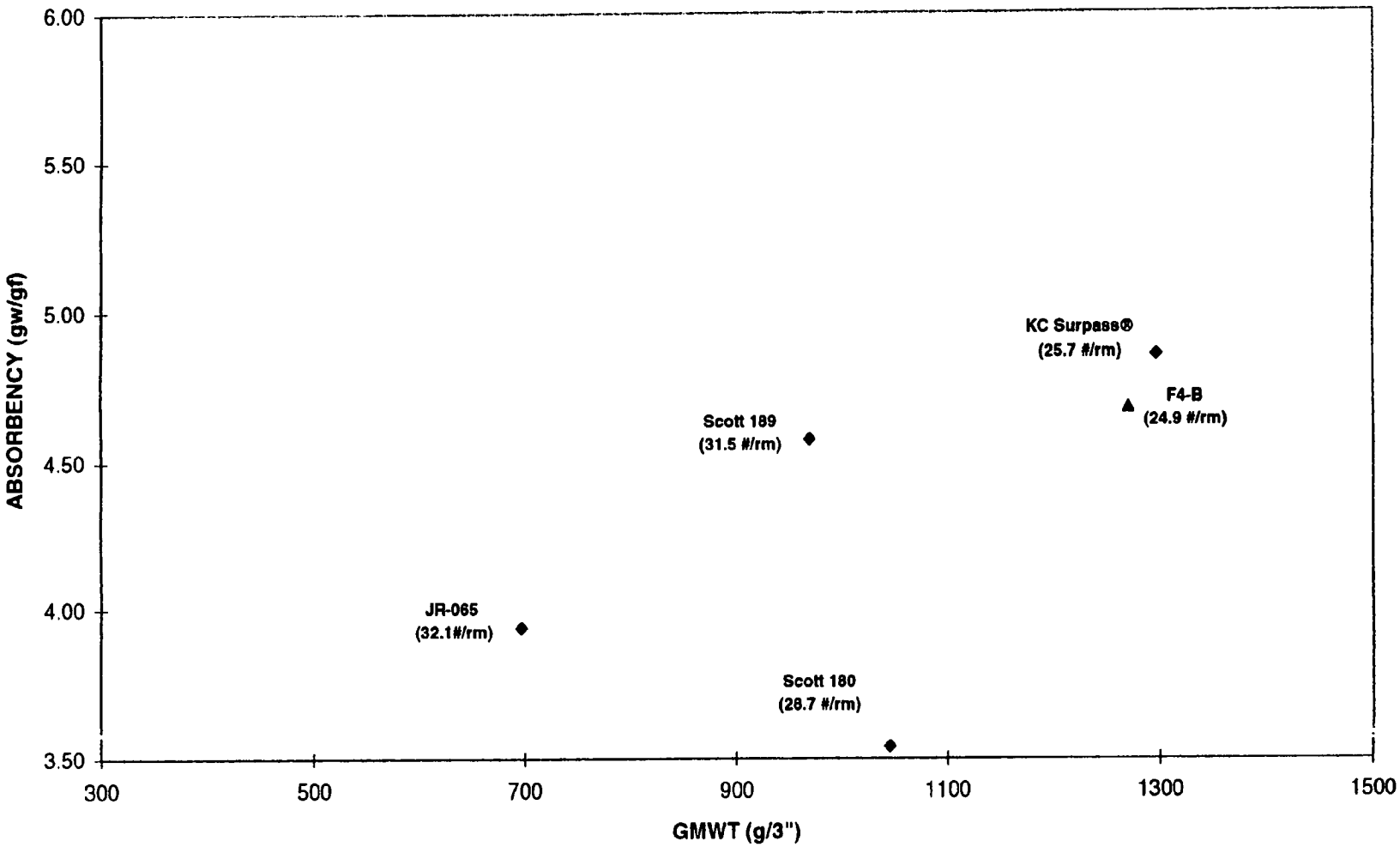
FIG. 7 illustrates the relationship between absorbency and geometric mean wet tensile strength.

FIG. 7 is a plot of the absorbency measured as grams of water absorbed per gram of fiber versus the geometric mean wet tensile strength. A towel product according to the present invention is labelled F4-B. For comparison purposes, the same data has been plotted for single-ply KC Surpass® 50000, Scott 180, Scott Select® 189 and one of James River's current commercial single-ply folded towel products.

Figure 8:
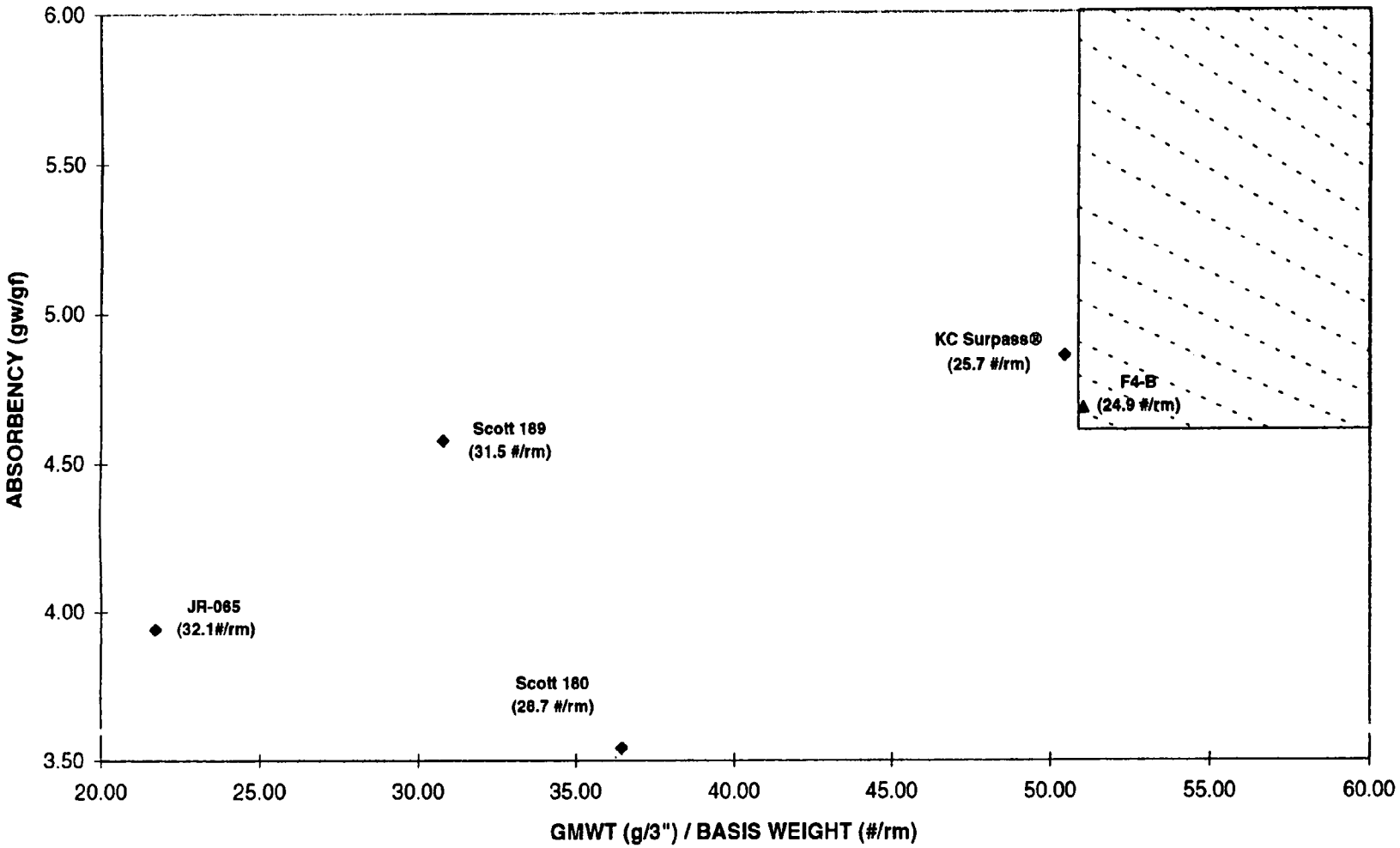
FIG. 8 illustrates the relationship between absorbency and geometric mean wet tensile strength per unit of the basis weight.

FIG. 8 is a plot of the absorbency measured as grams of water absorbed per gram of fiber versus the geometric mean wet tensile strength per unit of basis weight. A towel product according to the present invention is labelled F4-B. For comparison purposes, the same data has been plotted for single-ply KC Surpass® 50000, Scott 180, Scott Select® 189 and of one James River's current commercial single-ply folded towel products.

Figure 9:
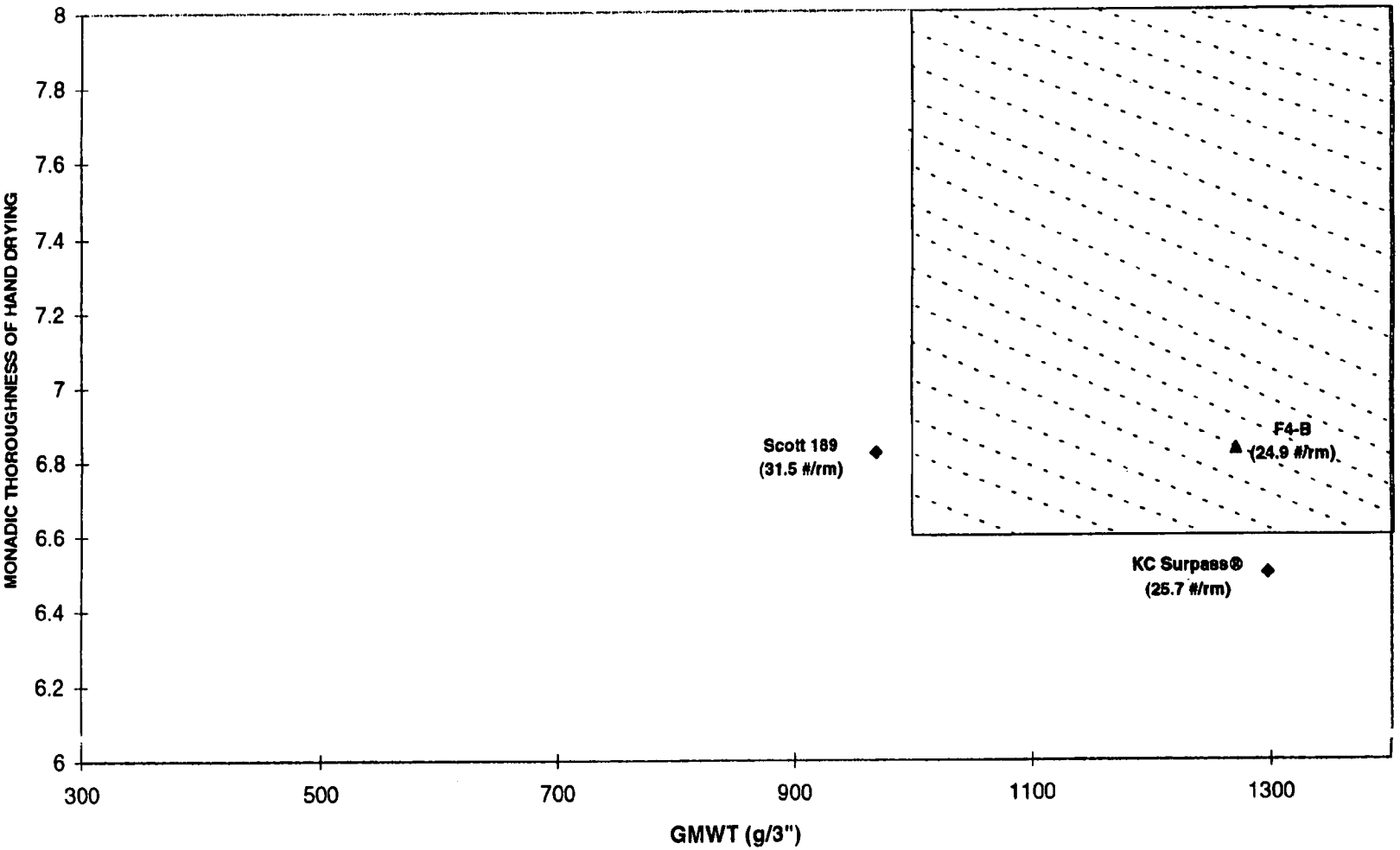
FIG. 9 illustrates the relationship between monadic thoroughness of hand drying and geometric mean wet tensile strength.

FIG. 9 is a plot of the relationship between the scalar rating of the subjective thoroughness of hand drying of a towel in a monadic test versus the geometric mean wet tensile strength. A towel product according to the present invention is labelled F4-B. For comparison purposes, the same data has been plotted for single-ply KC Surpass® 50000, and Scott Select® 189.

EXAMPLES 4-6

Examples 4 through 6 were carried out in the same manner as Example 1 except the conditions were as set forth in Table 3 below.

TABLE 3

| | EXAMPLE 4 | EXAMPLE 5 | EXAMPLE 6 |
|---|---|---|---|
| Machine Conditions: | | | |
| Furnish | 90% west coast long fiber 10% broke | 50% west coast long fiber 50% north central long fiber | 90% west coast long fiber 10% broke |
| Yankee Speed (fpm) | 2730 | 2730 | 2648 |
| Reel Speed (fpm) | 2456 | 2475 | 2414 |
| WSR (lbs/T) | 36 | 25 | 36 |
| CMC (lbs/T) | Varied to control headbox charge | Varied to control headbox charge | Varied to control headbox charge |
| Calendering | None | None | None |
| Refining Power (Kw) | 193 | 209 | 218 |
| Basis Weight (lb/rm) | 12.8 | 14.1 | 14.8 |
| % Crepe (%) | 10 | 9 | 9 |

EXAMPLE 7

Example 7 was carried out on a low speed pilot paper machine using a furnish of 30% southern hardwood/70% southern pine. The wet strength resin was KYMENE 557H® and was added at 20 lb/T. CMC 7MT was added at 0 to 12 lb/T in order to control headbox charge. The basis weight was approximately 16 lb/rm.

The results from Examples 4, 5, 6, and 7 are plotted in FIG. 10 as wet geometric mean breaking length versus headbox titratable charge and in FIG. 11 as wet geometric mean breaking length versus streaming current.

Other embodiments of the invention will be apparent to those skilled in the art from consideration of the specification and practice of the invention disclosed herein. It is intended that the specification and examples be considered as exemplary only, with the true scope and spirit of the invention being indicated by the following claims.

We claim:

1. A method of forming a cellulosic web comprising:

(a) supplying to a headbox an aqueous stream comprising a major proportion of refined long fiber;

(b) supplying to the aqueous stream a cationic wet strength agent and an anionic strength agent;

(c) measuring the total anionic charge carried by the aqueous stream;

(d) controlling the amount of the cationic wet strength agent and the anionic strength agent so that the net charge of the aqueous stream is maintained in the range of from less than about 0 to about −115 meq$\times 10^{-6}$ per 10 ml;

(e) depositing the aqueous stream on a first moving foraminous support to form a web;

(f) transferring the web to a second moving foraminous support;

(f) compressively dewatering the web;

(g) transferring the web to a Yankee cylinder to dry the web to a consistency of at most about 98%;

(i) creping the web from the Yankee cylinder.

2. The method of claim 1, wherein the cationic wet strength agent and the anionic strength agent are controlled so that the net charge of the aqueous stream is maintained in the range from less than about 0 to about −50 meq$\times 10^{-6}$ per 10 ml.

3. The method of claim 1, wherein the speed of said second moving foraminous support is at least about 2% less than the speed of the first moving foraminous support, thereby imparting a fabric crepe to said web of at least about 2%.

4. The method of claim 1, wherein the Yankee cylinder is internally heated.

5. The method of claim 1, wherein said creping imparts a reel crepe to said web of at least about 2%.

6. The method of claim 5, further comprising:

embossing said web to a sufficient degree to reduce its tensile modulus of stiffness by at least about 10%.

* * * * *